US009556721B2

(12) United States Patent
Jang et al.

(10) Patent No.: US 9,556,721 B2
(45) Date of Patent: Jan. 31, 2017

(54) DUAL-PUMP FORMATION FRACTURING

(71) Applicant: Schlumberger Technology Corporation, Sugar Land, TX (US)

(72) Inventors: In Chul Jang, Sugar Land, TX (US); Mark Milkovisch, Cypress, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 333 days.

(21) Appl. No.: 13/708,600

(22) Filed: Dec. 7, 2012

(65) Prior Publication Data

US 2014/0158345 A1 Jun. 12, 2014

(51) Int. Cl.

| | |
|---|---|
| ***E21B 43/26*** | (2006.01) |
| ***E21B 43/00*** | (2006.01) |
| ***E21B 47/06*** | (2012.01) |
| ***E21B 49/08*** | (2006.01) |

(52) U.S. Cl.

CPC ..... *E21B 43/26* (2013.01); *E21B 43/00* (2013.01); *E21B 43/261* (2013.01); *E21B 47/06* (2013.01); *E21B 49/081* (2013.01)

(58) Field of Classification Search

USPC ..... 166/250.1, 281, 305.1, 308.1

See application file for complete search history.

(56) References Cited

U.S. PATENT DOCUMENTS

| | | | | |
|---|---|---|---|---|
| 3,985,472 | A | 10/1976 | Virtue et al. | |
| 5,295,393 | A | 3/1994 | Thiercelin | |
| 5,558,160 | A | 9/1996 | Tudor | |
| 7,757,551 | B2 | 7/2010 | Meister | |
| 7,934,547 | B2 | 5/2011 | Milkovisch et al. | |
| 8,146,416 | B2 | 4/2012 | Pisio et al. | |
| 2004/0253094 | A1 | 12/2004 | Keener | |
| 2006/0054323 | A1 | 3/2006 | Grant et al. | |
| 2006/0168955 | A1 | 8/2006 | Longfield et al. | |
| 2009/0044951 | A1* | 2/2009 | Milkovisch et al. | 166/369 |
| 2010/0206548 | A1 | 8/2010 | Pisio et al. | |
| 2011/0100641 | A1 | 5/2011 | Briquet et al. | |
| 2011/0107830 | A1* | 5/2011 | Fields | E21B 7/061 73/152.41 |
| 2011/0127038 | A1* | 6/2011 | Mack et al. | 166/308.1 |
| 2011/0132609 | A1* | 6/2011 | Van Hal | E21B 36/008 166/300 |
| 2012/0067582 | A1 | 3/2012 | Fincher | |

FOREIGN PATENT DOCUMENTS

| | | |
|---|---|---|
| EP | 2434092 A2 | 3/2012 |

OTHER PUBLICATIONS

International Search Report and Written Opinion issued Feb. 24, 2014 for International Patent Application No. PCT/US2013/071048, 15 pages total.

* cited by examiner

*Primary Examiner* — Taras P Bemko
(74) *Attorney, Agent, or Firm* — Michael Dae

(57) ABSTRACT

Methods comprising conveying a downhole tool within a wellbore penetrating a subterranean formation, wherein the downhole tool comprises a first pump and a second pump, and wherein at least one operational capability of the first and second pumps is substantially different. A fracture is initiated in the subterranean formation by pumping fluid into the formation using the first pump. The fracture is propagated in the subterranean formation by pumping fluid into the formation using the second pump.

16 Claims, 14 Drawing Sheets

DUAL-PUMP FORMATION FRACTURING

CROSS-REFERENCE TO RELATED APPLICATIONS

This application is related to commonly assigned U.S. Pat. No. 7,934,547 to Milkovisch, et al., titled "Apparatus and Methods to Control Fluid Flow in a Downhole Tool," which was filed Aug. 17, 2007, and which issued on May 3, 2011, the entire disclosure of which is hereby incorporated herein by reference.

BACKGROUND OF THE DISCLOSURE

Reservoir well production and testing involves drilling subsurface formations and monitoring various subsurface formation parameters. Drilling and monitoring often involves using downhole tools having electrical, mechanical and/or hydraulic devices. Pump systems are utilized to power downhole tools using hydraulic power. Such pump systems may be configured to draw hydraulic fluid from a reservoir and pump the fluid at a particular pressure and flow rate. The pump systems can be controlled to vary output pressures and/or flow rates to meet the needs of particular applications. In some example implementations, pump systems may also be utilized to draw and pump formation fluid from subsurface formations. A downhole string (e.g., a drill string, a wireline string, etc.) may include one or more pump systems depending on the operations to be performed using the downhole string.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
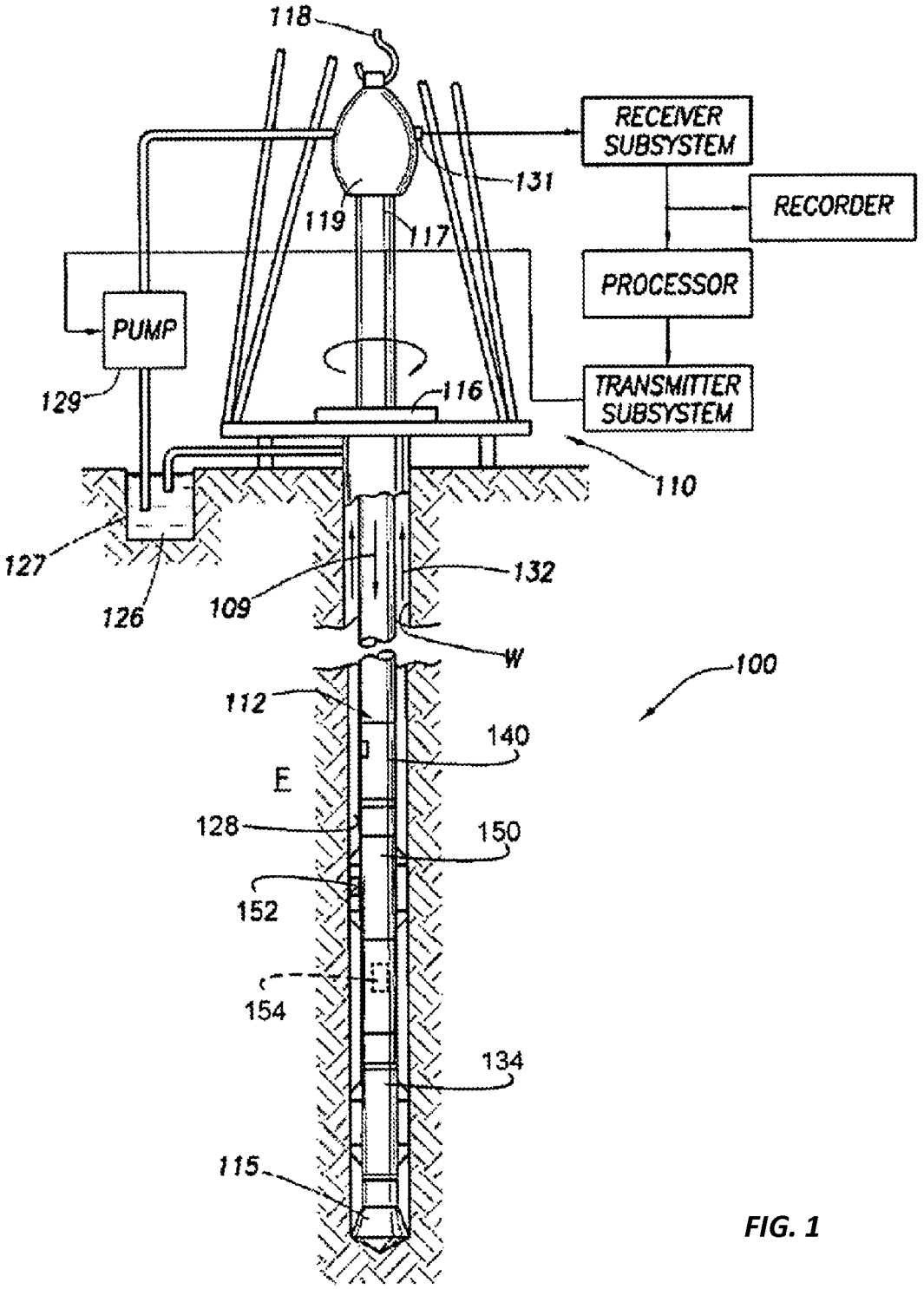
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and may or may not in itself dictate a relationship between the various embodiments and/or configurations discussed herein.

FIG. 1 illustrates an example drilling rig 110 and a drill string 112 in which the example apparatus and methods described herein may be used to control fluid flow associated with, for example, pumping fracturing fluid into or drawing formation fluid samples from a subsurface formation F. In the illustrated example, a land-based platform and derrick assembly 110 are positioned over a wellbore W penetrating the subsurface formation F. Rotary drilling in a manner that is well known may form the wellbore W. Those of ordinary skill in the art given the benefit of this disclosure will appreciate, however, that the apparatus and methods described herein may be applicable or readily adaptable to directional drilling applications, and are not limited to land-based rigs.

The drill string 112 is suspended within the wellbore W and includes a drill bit 115 at its lower end. The drill string 112 may be rotated by a rotary table 116, which engages a kelly 117 at an upper end of the drill string 112. The drill string 112 is suspended from a hook 118 via attachment to a traveling block (not shown) through the kelly 117 and a rotary swivel 119, which permits rotation of the drill string 112 relative to the hook 118.

Drilling fluid or mud 126 may be stored in a pit 127 formed at the well site. A pump 129 may deliver the drilling fluid 126 to the interior of the drill string 112 via a port (not shown) in the swivel 119, thus inducing the drilling fluid 126 to flow downwardly through the drill string 112 in a direction generally indicated by arrow 109. The drilling fluid 126 exits the drill string 112 via ports (not shown) in the drill bit 115, and then the drilling fluid 126 circulates upward through an annulus 128 between the outside of the drill string 112 and the wall of the wellbore W in a direction generally indicated by arrows 132. In this manner, the drilling fluid 126 may lubricate the drill bit 115 and/or carry formation cuttings up to the surface as it is returned to the pit 127 for recirculation.

The drill string 112 may comprise a bottom hole assembly (BHA) 100 near the drill bit 115 (e.g., within several drill collar lengths from the drill bit 115). The BHA 100 may comprise drill collars described below to measure, process and/or store information. The BHA 100 may also comprise a surface/local communications subassembly 140 to exchange information with surface systems.

The drill string 112 may further comprise one or more stabilizer collars 134, which may address the tendency of the drill string 112 to "wobble" and become decentralized as it rotates within the wellbore W, resulting in deviations in the direction of the wellbore W from the intended path (e.g., a straight vertical line). Such wobble can cause excessive lateral forces on sections (e.g., collars) of the drill string 112 as well as the drill bit 115, which may accelerate wear.

The BHA 100 may also comprise a probe tool 150 having a probe 152 to draw formation fluid from the formation F into a flowline of the probe tool 150. The BHA 100 may also comprise a pump system 154 to create a fluid flow and/or to provide hydraulic fluid power to devices, systems and/or apparatus in the BHA 100. The pump system 154 may be utilized for energizing a displacement unit (not shown) carried by the BHA 100, which may be utilized for drawing formation fluid or pumping fracturing fluid via the probe tool 150. The pump system 154 may be implemented according to one or more aspects of the present disclosure to control hydraulic fluid flow in the probe tool 150 and/or other portion of the BHA 100. For example, the pump system 154 may be implemented using the example pump systems described below in connection with FIGS. 6-13. Thus, for example, the pump system 154 may include two or more hydraulic pumps.

The scope of the present disclosure is not restricted to drilling operations. For example, one or more aspects of the present disclosure may be applicable or readily adaptable to operations related to well testing and/or servicing, among other oilfield services related applications. One or more aspects of the present disclosure may also or alternatively be applicable or readily adaptable to operations related to testing conducted in wells penetrating subterranean formations, as well as to operations utilizing formation evaluation tools conveyed within the borehole by any known means.

Figure 2:
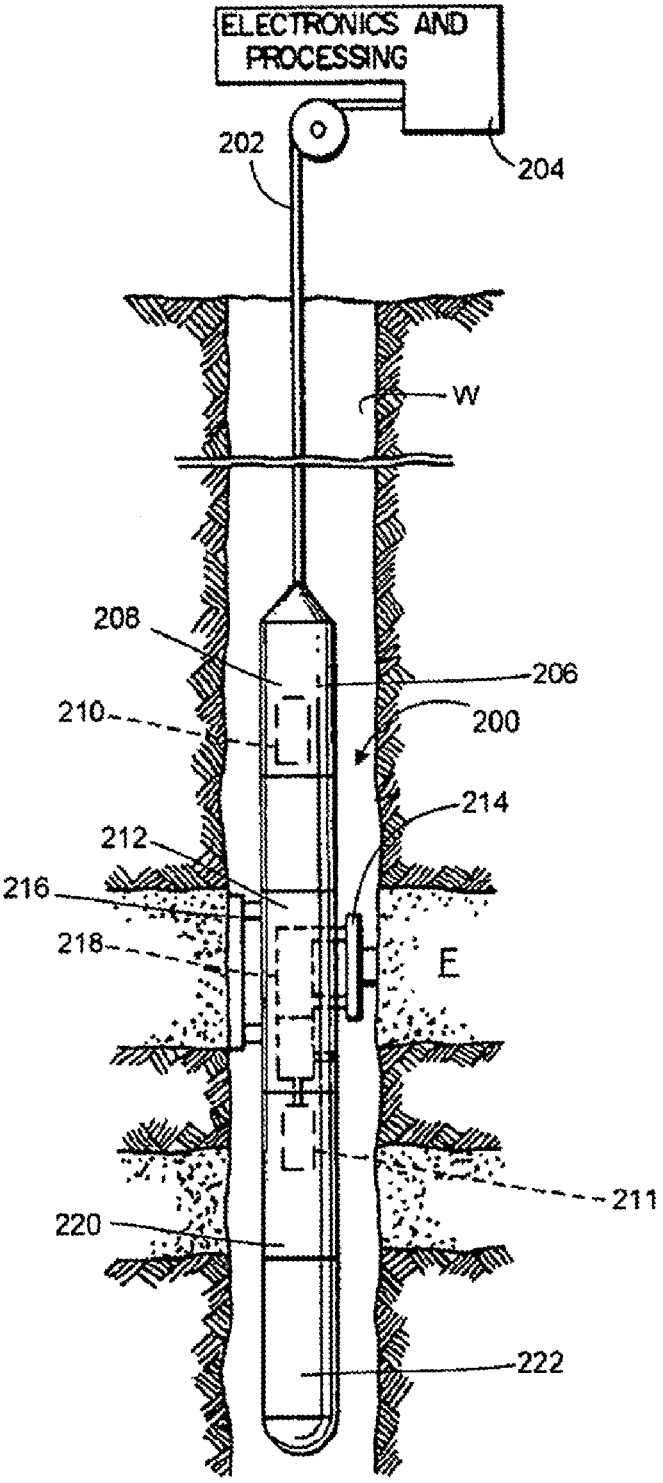
FIG. 2 is a schematic view of at least a portion of apparatus according to one or more aspects of the present disclosure.

For example, FIG. 2 is a schematic view of a downhole tool 200 for drawing formation fluid from or injecting fracturing fluid into the formation F. The downhole tool 200 is suspended in the wellbore W from the lower end of a multi-conductor cable 202 that is spooled on a winch (not shown) at the Earth's surface. On the surface, the cable 202 is communicatively coupled to an electrical control system 204.

The downhole tool 200 may comprise an elongated body 206, such as may comprise a control module 208 having at least a downhole portion of a tool control system 210 configured to control an example pump system 211 of the downhole tool 200. The pump system 211 may be utilized to pump hydraulic fluid to create different fluid flow rates and pressures, such as to provide fluid power to devices, systems and/or apparatus in the downhole tool 200, and to thereby extract formation fluid from the formation F or inject fracturing fluid into the formation F, for example. The control system 210 may also be configured to analyze and/or perform various measurements and/or testing.

The elongated body 206 may comprise a formation tester 212 having a selectively extendable fluid admitting assembly 214 and a selectively extendable tool anchoring member 216 that are respectively arranged on opposite sides of the elongated body 206. The fluid admitting assembly 214 may be configured to selectively seal off or isolate selected portions of the wellbore W so that pressure or fluid communication with the adjacent formation F may be established, such as to draw fluid samples from the formation F or inject fracturing fluid into the formation F. The formation tester 212 may also comprise a fluid analysis module 218 through which sampled formation fluid may flow. The sampled formation fluid may thereafter be expelled through a port (not shown), or sent to one or more fluid collecting chambers 220 and 222, based on information from the fluid analysis module 218. The fluid collecting chambers 220 and 222 may receive and retain the fluids obtained from the formation F for subsequent testing at the surface or a testing facility. Although the downhole control system 210 and the pump system 211 are shown in FIG. 2 as being implemented separate from the formation tester 212, the downhole control system 210 and the pump system 211 may be implemented in the formation tester 212.

Figure 3:
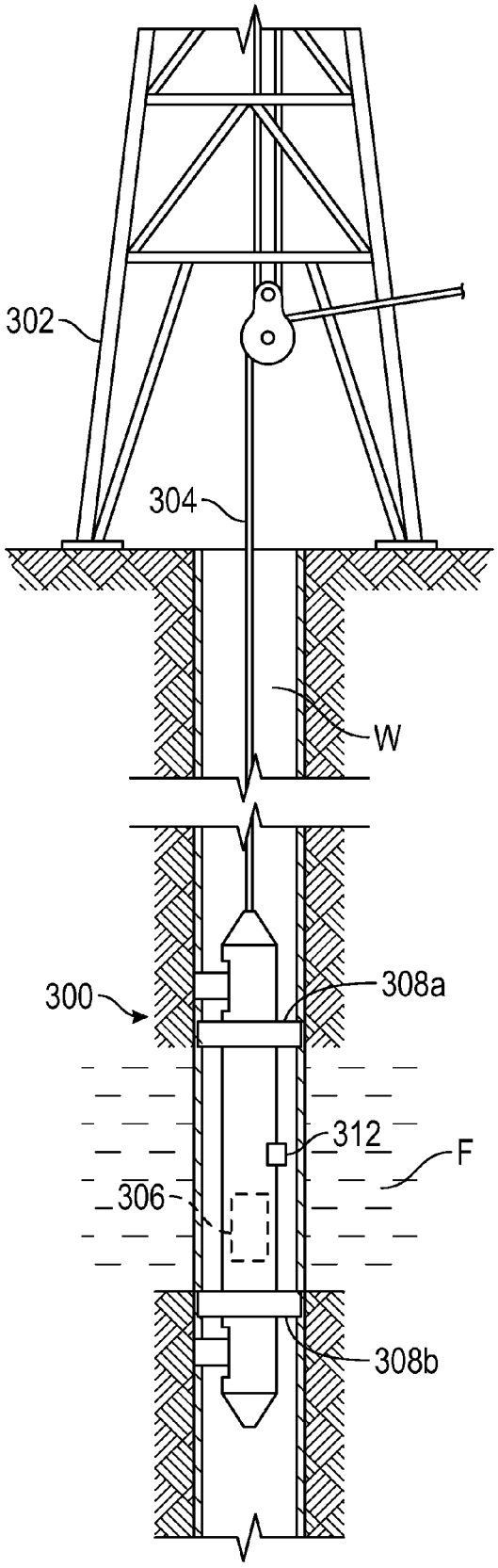
FIG. 3 is a schematic view of at least a portion of apparatus according to one or more aspects of the present disclosure.

FIG. 3 depicts another example downhole tool 300 that may be used to perform stress testing and/or to inject materials into the formation F according to one or more aspects of the present disclosure. The downhole tool 300 may be suspended in the wellbore W from a rig 302 via a multi-conductor cable 304, similar or identical to the embodiment shown in FIG. 2. The downhole tool 300 comprises a pump system 306 according to one or more aspects of the present disclosure. The downhole tool 300 may also comprise inflatable packers **308*a* and 308*b* configured to seal off or otherwise isolate a portion of the wellbore W. The downhole tool 300 also comprises one or more probes, ports and/or other outlets 312 that may be utilized to inject fracturing fluid and/or other fluids into the isolated portion of the wellbore W within the interval sealed between the inflated packers 308*a* and 308*b*. The one or more probes, ports and/or other outlets 312** may also or alternatively be utilized to inject fracturing fluid and/or other fluids directly into the formation F.

Figure 4A:
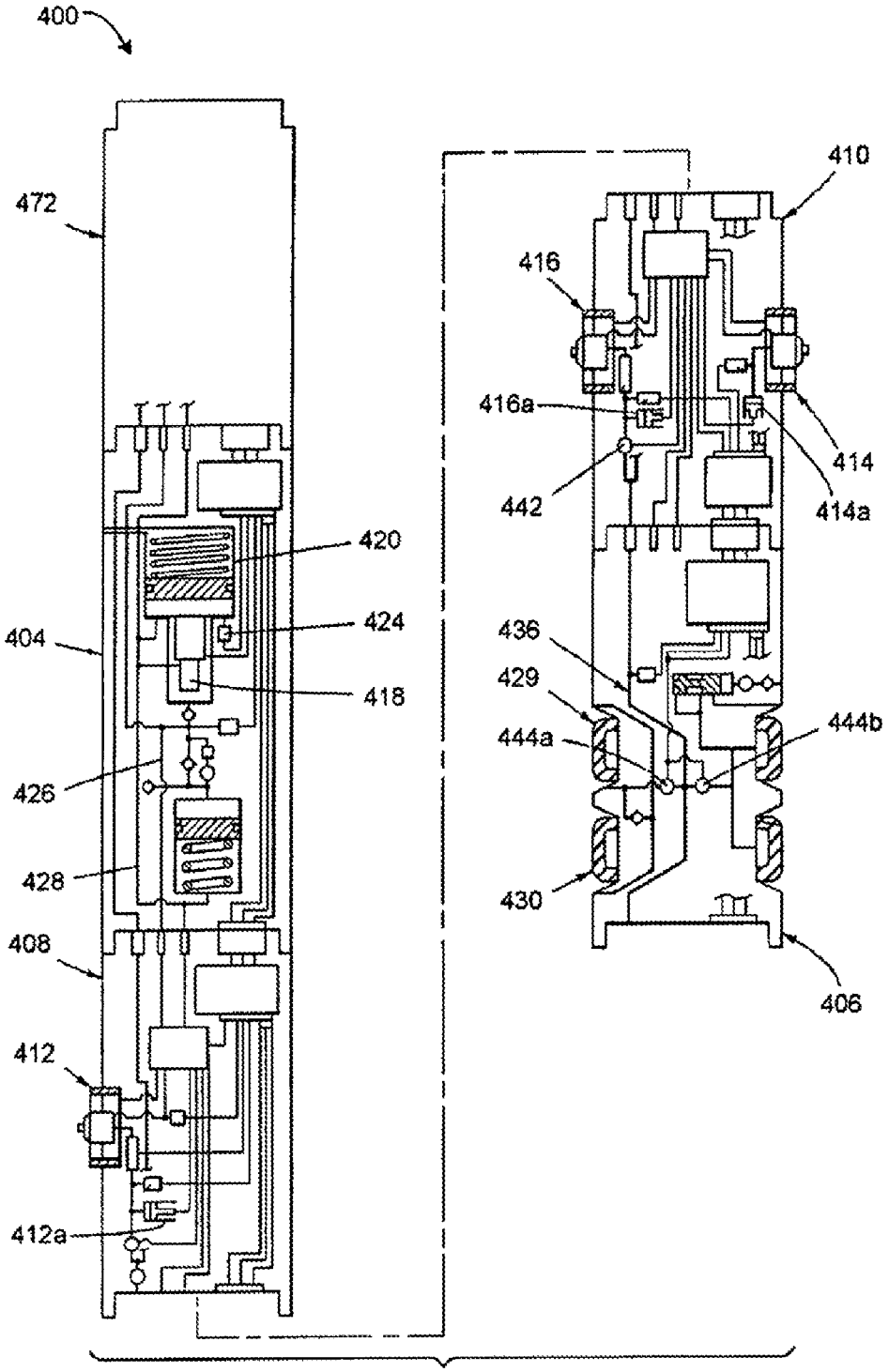
FIGS. 4A and 4B are schematic views of portions of apparatus according to one or more aspects of the present disclosure.
Figure 4B:
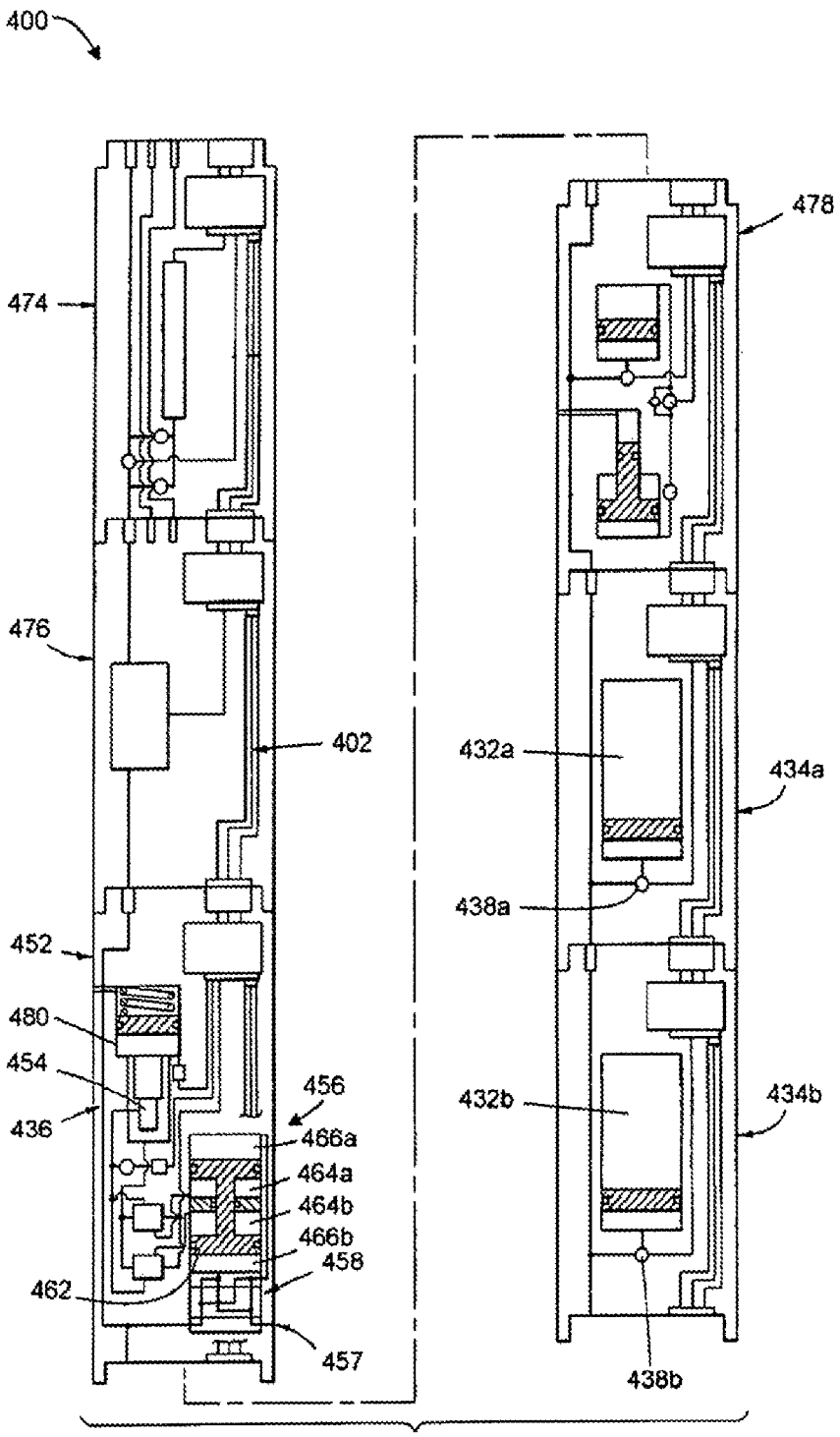

FIGS. 4A and 4B are schematic views of portions of a downhole tool 400 according to one or more aspects of the present disclosure. The downhole tool 400 may comprise a plurality of modules that may be individually or collectively utilized to implement one or more aspects of the present disclosure. The portion of the downhole tool 400 shown in FIG. 4A may be coupled to the portion of the downhole tool 400 shown in FIG. 4B by, for example, coupling the lowermost collar or module of the portion shown in FIG. 4A to the uppermost collar or module of the portion shown in FIG. 4B. However, although the downhole tool 400 is depicted in FIGS. 4A and 4B and described herein as being implemented using a modular configuration, embodiments in which the downhole tool 400 may be implemented using a unitary tool configuration are also within the scope of the present disclosure. Moreover, at least a portion of the downhole tool 400 may be utilized to implement any of the example apparatus shown in FIGS. 1-3 or otherwise within the scope of the present disclosure, including for extracting formation fluid from the formation F, injecting fluid into the formation F, and/or conducting formation property tests.

Power and communication lines may extend along a substantial length of the downhole tool 400, as generally referred to in FIG. 4B by reference numeral 402. Such power supply and communication lines 402 may be configured to transfer electrical power to electrical components of the downhole tool 400 and/or to communicate information within and/or outside the downhole tool 400.

The downhole tool 400 may comprise a hydraulic power module 404, a packer module 406, a probe module 408 and a multi-probe module 410. The probe module 408 may comprise a probe assembly 412, such as may be utilized to draw fluid from the formation into the downhole tool 400, inject fluid from the downhole tool 400 into the formation, and/or test isotropic permeability and/or other properties of the formation. The multi-probe module 410 may comprise a horizontal probe assembly 414 and a sink probe assembly 416, which may also or alternatively be utilized to draw fluid from the formation into the downhole tool 400, inject fluid from the downhole tool 400 into the formation, and/or test isotropic permeability and/or other properties of the formation. The hydraulic power module 404 may comprise a pump system 418 and a hydraulic fluid reservoir 420, which may be individually or collectively utilized to control drawing of formation fluid via the probe assemblies 412, 414 and/or 416, and/or to control flow rate and pressure of hydraulic fluid and/or formation fluid in the downhole tool 400, among other possible uses within the scope of the present disclosure. For example, the pump system 418 may be utilized to control whether the probe assemblies 412, 414 and/or 416 admit formation fluid or prevent formation fluid from entering the downhole tool 400. The pump system 418 may be utilized to create different flow rates and fluid pressures necessary for operating other devices, systems and/or apparatus of the downhole tool 400. For example, the downhole tool 400 may also comprise a low oil switch 424 that can be utilized to regulate operation of the pump system 418.

A hydraulic fluid line 426 connected to the discharge of the pump system 418 may extend through the hydraulic power module 404 and into adjacent modules to provide hydraulic power. For example, the hydraulic fluid line 426 may extend through the hydraulic power module 404 and into the packer module 406 and the probe module 408 and/or 410 depending upon whether one or both are used. The hydraulic fluid line 426 and a return hydraulic fluid line 428 may form a closed loop. The return hydraulic fluid line 428 may extend from the probe module 408 (and/or 410) to the hydraulic power module 404, and may terminate at the hydraulic fluid reservoir 420.

The pump system 418 may be utilized to provide hydraulic power to the probe module 408 and/or 410 via the hydraulic fluid line 426 and the return fluid line 428. The hydraulic power provided by the pump system 418 may be utilized for actuating drawdown pistons 412*a*, 414*a* and/or 416*a* associated with the extendable probes 412, 414 and/or 416, respectively. The hydraulic power provided by the pump system 418 may also or alternatively be utilized for extending and/or retracting the extendable probes 412, 414 and/or 416. Alternatively, or additionally, the hydraulic power provided by the pump system 418 may be utilized for extending and/or retracting one or more setting pistons (not shown), such as may be employed to anchor the downhole tool 400 at a desired depth and/or azimuth within the wellbore.

As best shown in FIG. 4B, the downhole tool 400 may comprise a pump out module 452 having a flowline 436 running therethrough. The pump out module 452 may be utilized to transfer formation fluid to and/or from the formation into the downhole tool 400. For example, the pump out module 452 may be utilized to draw formation fluid from the formation into the flowline 436 until substantially clean formation fluid passes through a fluid analysis module. Alternatively, or additionally, the pump out module 452 may be utilized to inject fracturing fluid, wellbore fluid and/or other fluid into the formation.

The pump out module 452 may comprise a pump system 454 and a displacement unit 456 coupled to the pump system 454. Fluid may be drawn or injected via a flowline 457 coupled to a control valve block 458. The control valve block 458 may comprise four check valves (not shown), as is well known to those skilled in the art. The displacement unit 456 may comprise a dumbbell-type piston 462, two hydraulic fluid chambers 464*a-b*, and two fluid chambers 466*a-b*. The pump system 454 may operate to force fluid into and out of the hydraulic fluid chambers 464*a-b* in an alternating fashion to actuate the piston 462. As the piston 462 actuates, a first end of the piston 462 pumps fluid using the first fluid chamber 466*a* and a second end pumps fluid using the second fluid chamber 466*b*. The control valve block 458 may be utilized to control the coupling of fluid paths between the displacement unit 456 and the flowlines 436 and 457 to enable one of the fluid chambers 466*a-b* or the displacement unit 456 to draw formation fluid and the other one of the fluid chambers 466*a-b* to expel fracturing fluid.

According to one or more aspects of the present disclosure, the pump system 454 may be utilized to control the flow rate and pressure of fluid pumped into or from the downhole tool 400, such that apparatus and/or methods within the scope of the present disclosure may be utilized to vary fluid flow rates while maintaining different desired fluid pressures. However, pump systems other than the pump system 454 shown in FIG. 4B may also or alternatively be utilized within the scope of the present disclosure. For example, formation fluid may be routed to the hydraulic fluid chambers 464*a-b*, or hydraulic fluid may be routed to the fluid chambers 466*a-b*. Such alternate embodiment may be useful, for example, for achieving a formation fluid flow rate lower than the hydraulic fluid flow rate.

To inflate and deflate the packers 429 and 430 (best shown in FIG. 4A) utilizing the pump out module 452 of FIG. 4B, the pump out module 452 may be selectively enabled to activate the pump system 454. For example, the check valves controlling the valve block 458 may be operated to reverse the flow direction discussed above. In such a scenario, wellbore fluid may be pumped into the downhole tool 400 via the flowline 457 and circulated through various modules via the flowline 436. The valves 444*a-b* (FIG. 4A) may be controlled to route wellbore fluid to and/or from the packers 429 and 430 to selectively inflate and/or deflate the packers 429 and 430. Alternatively, the packer module 406 may comprise a pumping system (which may be similar to pump system 418 or 454) capable of directly inflating the packers 429 and 430.

Various configurations of the downhole tool 400 may be implemented based on the tasks and/or tests to be performed. To perform basic sampling, the hydraulic power module 404 may be utilized in combination with an electric power module 472, the probe module 408 and the sample chamber modules 434*a-b*. To perform reservoir pressure testing, the hydraulic power module 404 may be utilized in combination with the electric power module 472, the probe module 408 and a precision pressure module 474. For uncontaminated sampling at reservoir conditions, the hydraulic power module 404 may be utilized in combination with the electric power module 472, the probe module 408, a fluid analysis module 476, the pump out module 452 and the sample chamber modules 434*a-b*. To measure isotropic permeability, the hydraulic power module 404 may be utilized in combination with the electric power module 472, the probe module 408, the precision pressure module 474, a flow control module 478 and the sample chamber modules 434*a-b*. For anisotropic permeability measurements, the hydraulic power module 404 may be utilized with the probe module 408, the multi-probe module 410, the electric power module 472, the precision pressure module 474, the flow control module 478 and the sample chamber modules 434*a-b*. A simulated drillstem test (DST) may be performed utilizing the electric power module 472 in combination with the packer module 406, the precision pressure module 474 and the sample chamber modules 434*a-b*. Other configurations may also be used to perform other desired tasks or tests.

Figure 5:
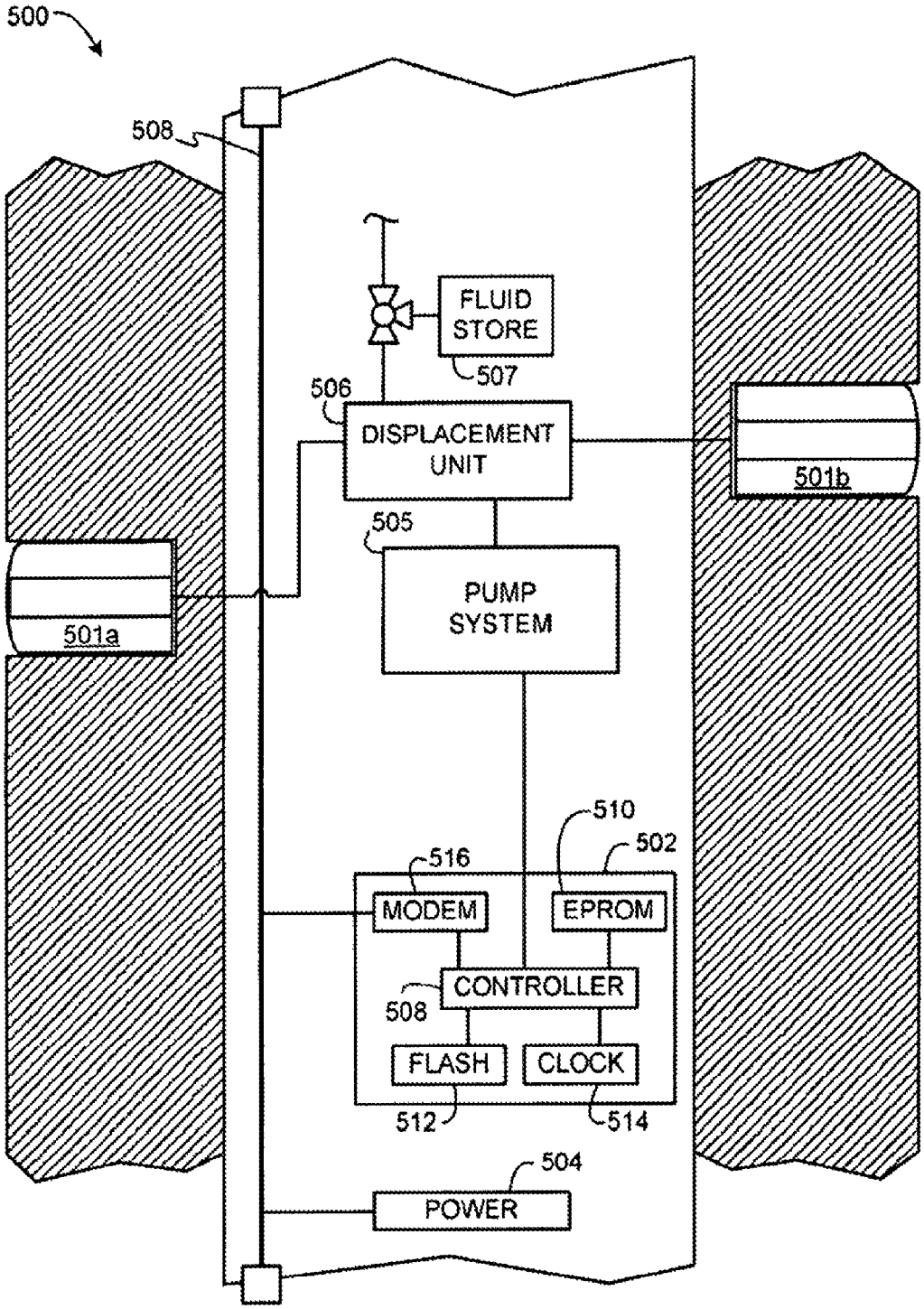
FIG. 5 is a schematic view of a portion of apparatus according to one or more aspects of the present disclosure.

FIG. 5 is a schematic view of at least a portion of an apparatus 500 according to one or more aspects of the present disclosure. The apparatus 500 may be implemented in or as a tool string (such as those shown in FIGS. 1-3) to control fluid flow rates and/or fluid pressures associated with, for example, hydraulic fluid, fracturing fluid and/or formation fluid. In FIG. 5, lines shown connecting blocks represent fluid or electrical connections that may comprise one or more flowlines or one or more wires or conductive paths. For clarity, however, some connections have been omitted from FIG. 5, with the understanding that the scope of the present disclosure includes such connections/line despite their omission from FIG. 5.

The apparatus 500 comprises an electronics system 502 and a power source 504 (battery, turbine driven by drilling fluid flow 109, etc.) operable to power the electronics system 502. The power source 504 may comprise one or more batteries, one or more turbines driven by drilling fluid flow, and/or other power sources. The electronics system 502 may control operations of the apparatus 500 to control fluid flow rates and/or fluid pressures, such as to draw formation fluid through the probes 501*a* and/or 501*b*, to inject fracturing fluid through the probes 501*a* and/or 501*b*, and/or to provide fluid power to other devices, systems and/or apparatus within the tool string. The electronics system 502 may be coupled to a pump system 505 that may be substantially similar or identical to the pump system 154 shown in FIG. 1, which may be implemented using one or more of the example pump systems described below in connection with FIGS. 6-12. The pump system 505 may be coupled to or otherwise be configured to drive a displacement unit 506, such as to draw formation fluid through the probes 501*a* and/or 501*b* and/or to inject fracturing fluid through the probes 501*a* and/or 501*b*. The displacement unit 506 may be substantially similar or identical to the displacement unit 456 described above in connection with FIG. 4B. The electronics system 502 may be configured to control fluid flow by controlling the operation of the pump system 505. The electronics system 502 may also be configured to control whether extracted formation fluid is stored in a fluid store 507 (e.g., sample chambers) or is routed back out of the apparatus 500 (e.g., pumped back into the wellbore). Additionally, the electronics system 502 may be configured to control other operations of the tool string, such as for test and/or analysis operations, data communication operations and/or others. The power source 504 may be connected to a tool bus 508 and/or other means configured to transmit electrical power and/or communication signals.

The electronics system 502 may be provided with a controller 508 (e.g., a processor and memory) to implement control routines, such as routines that control the pump system 505, among others. The controller 508 may be configured to receive data from sensors (e.g., fluid flow sensors) in the apparatus 500 and/or elsewhere and execute different instructions depending on the data received, such as analyzing, processing and/or compressing the received data, and the like. The electronics system 502 may comprise an electrically programmable read only memory (EPROM) 510 configured to, for example, store machine accessible instructions that, when executed by the controller 508, cause the controller 508 to implement control routines and/or other processes.

The electronics system 502 may also or alternatively comprise flash memory 512 configured to, for example, store data acquired by the apparatus 500. The electronics system 502 may also or alternatively comprise a clock 514, such as to implement timed events and/or generate time-stamp information. The electronics system 502 may also or alternatively comprise a modem 516 and/or other communication means coupled to the tool bus 506, such as to communicate information when the apparatus 500 is downhole. Thus, the apparatus 500 may send data to and/or receive data from the surface. Alternatively, or additionally, such data may be downloaded via a readout port when the testing tool is retrieved to the surface.

FIGS. 6-13 depict example pump systems that may be used to implement the example pump systems 154, 211, 306, 418, 454, and 505 of FIGS. 1-5 according to one or more aspects of the present disclosure. One or more of the pumps systems shown in FIGS. 6-13 may allow a relatively larger range of flow rates than traditional pump systems can achieve. For example, the example pump systems of FIGS. 6-13 may be controlled to a fluid flow rate and/or to a fluid differential pressure across the pump within flow rates and pressure ranges that are relatively larger or wider than ranges of traditional pump systems. Achieving a relatively higher fluid flow rate in a traditional pumping system may limit the minimum flow rate that can be achieved. Similarly, achieving a relatively lower fluid flow rate in a traditional pumping system may limit the maximum flow rate that can be achieved. However, pump systems according to one or more aspects of the present disclosure may be configured to operate at relatively lower and higher fluid flow rates.

Each of the pump systems shown in FIGS. 6-13 comprises one or more motors that may be implemented using electric motors and/or others motors or actuation devices capable of providing a torque to a driving shaft, such as a turbine powered by drilling fluid. For example, where the power source 504 shown in FIG. 5 is a turbine driven by the drilling fluid flow 109 shown in FIG. 1. In embodiments in which the torque is provided via one or more electric motors, the electric motors may be equipped with a resolver that may be utilized, for example, in determining an angular position of the driving shaft, among other uses. Such electric motors may be equipped with a current sensor that may be utilized, for example, in determining the torque provided by the motor(s) at the driving shaft, among other uses.

Each of the pump systems shown in FIGS. 6-13 also comprises at least two pumps. The pumps may be or comprise positive displacement pumps, although others are also within the scope of the present disclosure. Such positive displacement pumps may be reciprocating pumps or progressive cavity pumps, among others within the scope of the present disclosure. Alternatively, or additionally, the at least two pumps may be or comprise variable-displacement pumps (e.g., constant power pumps) or fixed-displacement pumps. For example, all of the pumps of a pumping system introduced herein may be implemented using variable-displacement pumps, all of the pumps may be implemented using fixed-displacement pumps, or the pumps may be implemented using a combination of variable-displacement and fixed-displacement pumps. Downhole electronics (such as the control system 210 shown in FIG. 2 and/or the electronics 502 shown in FIG. 5) may control the variable displacement pumps by, for example, controlling the angle of a swashplate thereof.

Each of the example pump systems of FIGS. 6-13 may be configured to pump hydraulic fluid from a reservoir (such as the reservoir 420 and/or the reservoir 480 shown in FIGS. 4A and 4B). Each of the example pump systems of FIGS. 6-13 may also comprise a port that may be coupled to a displacement unit (e.g., the displacement unit 456 of FIG. 4B and/or the displacement unit 506 of FIG. 5), such as to draw fluid from the formation or inject fluid into the formation. Although the displacement units are not shown in FIGS. 6-13, the interested reader is referred to FIGS. 4B and 5 for illustrations of how the example displacement units 456 and 506 may be coupled to pump systems within the scope of the present disclosure. The example pump systems of FIGS. 6-13 may also be used to provide fluid power to devices, systems and/or apparatus other than displacement units that are operated or controlled using hydraulic or other fluid. For example, the example pump systems of FIGS. 6-13 may be fluidly coupled to hydraulic motors, pistons, extendable/retractable probes, etc., and/or to an actuator in the downhole tool, such as the drawdown pistons 412*a*, 414*a* or 416*a* shown in FIG. 4A, the displacement unit 456 shown in FIG. 4B, and/or the displacement unit 506 shown in FIG. 5.

It should also be noted that the types of actuators to which the example pump systems of FIGS. 6-13 are connected are not limited to the shown examples. Furthermore, although the example pump systems of FIGS. 6-13 are described below as pumping hydraulic fluid and drawing hydraulic fluid from a hydraulic fluid reservoir, in other example implementations, the pump systems may be configured to pump drilling fluid (from a drilling fluid reservoir or other source within the downhole tool) or formation fluid (from a formation fluid reservoir or other source within the downhole tool).

In addition to the measurements performed on the motor (such as rotational speed, torque and angular position, among other examples), it may be advantageous in some cases to also measure the hydraulic fluid pressure and/or the fluid flow rate at the inlet and/or the outlet of the at least two pumps. The temperature of hydraulic fluid may also be monitored. These temperature measurements, as well as other measurements mentioned above or otherwise, may be indicative of the state of the example pump systems shown in FIGS. 6-13. All or some of these measurements may be displayed to an operator and/or fed to a closed control loop of the pump system of FIGS. 6-13, among other options within the scope of the present disclosure.

Figure 6:
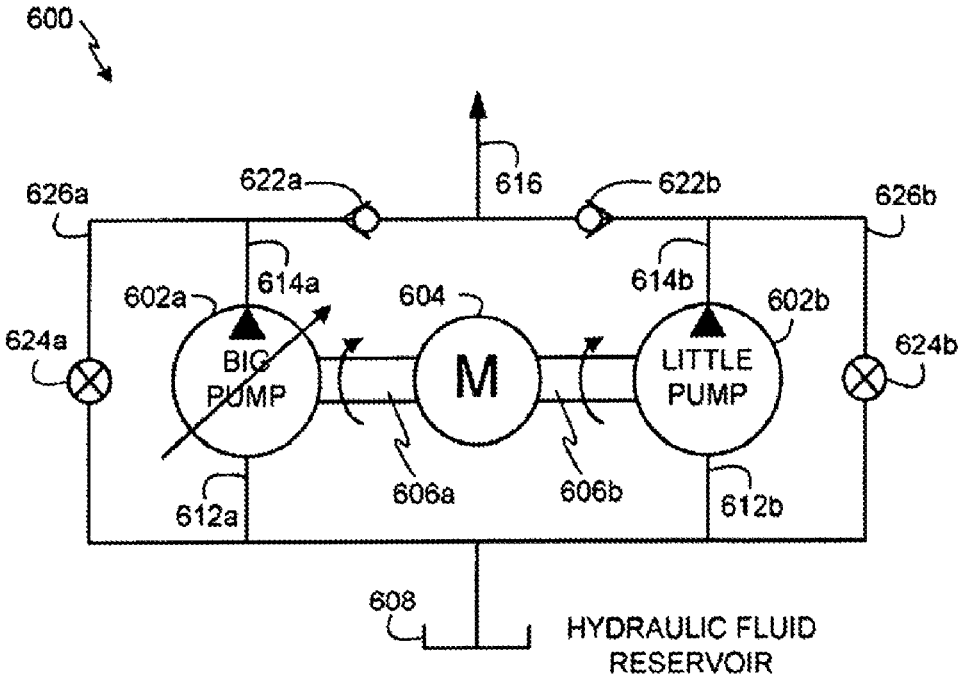
FIG. 6 is a schematic view of a portion of apparatus according to one or more aspects of the present disclosure.

FIG. 6 is a schematic view of an example tandem pump system 600 according to one or more aspects of the present disclosure. The tandem pump system 600 may comprise two pumps 602*a* and 602*b* and a common motor or other actuation device 604. In the example shown in FIG. 6, the motor 604 is a dual shaft motor having a first shaft 606*a* coupled to the pump 602*a* and a second shaft 606*b* coupled to the pump 602*b*. The pump 602*a* may be implemented using a "big" pump, and the pump 602*b* may be implemented using a "little" pump. That is, the big pump 602*a* may have a relatively larger displacement relative to the little pump 602*b*. In this manner, the big pump 602*a* may be utilized to create relatively higher flow rates (and often relatively lower fluid differential pressures), and the little pump 602*b* may be utilized to create relatively lower fluid flow rates (and often higher fluid differential pressures). For example, if the combined operating range of the little pump 602*b* and the big pump 602*a* is 0-100%, then the little pump 602*b* may operate in a range between 0-14% and 0-18% and the big pump 602*a* may operate approximately in a range between 12-100% and 16-100%. That is, the little pump 602*b* may have an operating range that may be approximately ⅙ to ⅛ the operating range of the big pump 602*a*, or the operating range of the little pump 602*b* may be approximately 1/100 to 1/10 of the upper range of the big pump 602*a*.

In the example shown in FIG. 6, the motor 604 may actuate both of the pumps 602*a* and 602*b* at the same time, such that the pumps 602*a* and 602*b* may simultaneously pump hydraulic fluid. As the pumps 602*a* and 602*b* are actuated, they may draw hydraulic fluid from a hydraulic fluid reservoir 608 via respective ingress hydraulic fluid lines 612*a* and 612*b*, and subsequently pump the hydraulic fluid to respective egress hydraulic fluid lines 614*a* and 614*b* toward an output 616. The hydraulic fluid reservoir 608 may be integral or otherwise associated with the pump system 600, or may be disposed in another location, assembly and/or module of the downhole tool. The output 616 may be coupled to another device, system and/or apparatus that operates or is controlled using hydraulic fluid or other fluid power. For example, the output 616 may be fluidly coupled to the displacement unit 456 shown in FIG. 4B or the displacement unit 506 shown in FIG. 5. The pump system 600 may also comprise check valves 622*a-b* that may: (1) prevent fluid from flowing from the little pump 602*b* into a pump output of the big pump 602*a* and/or (2) prevent fluid from flowing from the big pump 602*a* into a pump output of the little pump 602*b*. However, this may also be achieved via means other than check valves within the scope of the present disclosure.

The pump system may also comprise 2-port, 2-position valves 624*a* and 624*b* operable to, for example, control the flow rates and pressures created by the pump system 600. For example, the valves 624*a* and 624*b* may be controlled by the electronics system 502 shown in FIG. 5, the downhole controller 210 shown in FIG. 2, and/or the uphole controller 204 shown in FIG. 2. Because the motor 604 turns both of the pumps 602*a* and 602*b* simultaneously, the pumps 602*a* and 602*b* may pump fluid simultaneously. To control the flow rates created at the output 616 by the pumped hydraulic fluid, the valves 624*a* and 624*b* may control the routing of the fluid from the pumps 602*a* and 602*b* to the output 616. For example, to create a relatively low flow rate at the output 616, the electronics system 502 shown in FIG. 5 or the controller 210/204 shown in FIG. 2 may open the valve 624*a* corresponding to the big pump 602*a* and close the valve 624*b* corresponding to the little pump 602*b*. In this manner, fluid pumped by the big pump 602*a* may be routed (or re-circulated) via a return flowline 626*a* back to the fluid reservoir 608 and/or the ingress flowline 612*a* so that the big pump 602*a* may not substantially affect the flow rate and the pressure at the output 616. By closing the valve 624*b*, the fluid pumped by the little pump 602*b* may be routed to the output 616 so that the little pump 602*b* creates a relatively low flow rate at the output 616. To create a relatively high flow rate, the electronics system 502 shown in FIG. 5 or the controller 210/204 shown in FIG. 2 may close the valve 624*a* and open the valve 624*b* so that fluid pumped by the little pump 602*b* may be routed (or re-circulated) via a return flowline 626*b* back to the reservoir 608 and/or the ingress flowline 612*b* and fluid pumped by the big pump 602*a* may be routed to the output 616. The valve 624*a* and/or the valve 624*b* may be implemented with metering or needle valves, and the electronics system 502 shown in FIG. 5 or the controller 210/204 shown in FIG. 2 may be configured to at least partially open the valve 624*a* and/or 624*b* to vary the flow rate at the output 616 by varying the amount of fluid routed from the pumps 602*a-b* to the output 616.

In an alternative example implementation, the valve 624*b* and the return flowline 626*b* may be omitted so that fluid pumped by the little pump 602*b* may always be routed to the output 616. When a relatively low flow rate is desired at the output 616, the electronics system 502 shown in FIG. 5 or the controller 210/204 shown in FIG. 2 may open the valve 624*a* to route fluid pumped by the big pump 602*a* away from the output 616, so that the pressure and flow rate at the output 616 are based on the little pump 602*b*. When a relatively high flow rate is desired, the electronics system 502 shown in FIG. 5 or the controller 210/204 shown in FIG. 2 may close the valve 624*a* to route fluid pumped by the big pump 602*a* to the output 616. The electronics system 502 shown in FIG. 5 or the controller 210/204 shown in FIG. 2 may be configured to partially open the valve 624*a* to vary the pressure and flow rate at the output 616 by varying the amount of fluid routed from the big pump 602*a* to the output 616. It should be understood that the pump system 600 is not limited to any particular types of valves, and that other devices capable of selectively varying, restricting, allowing and/or stopping the flow in a flowline are also within the scope of the present disclosure.

Figure 7:
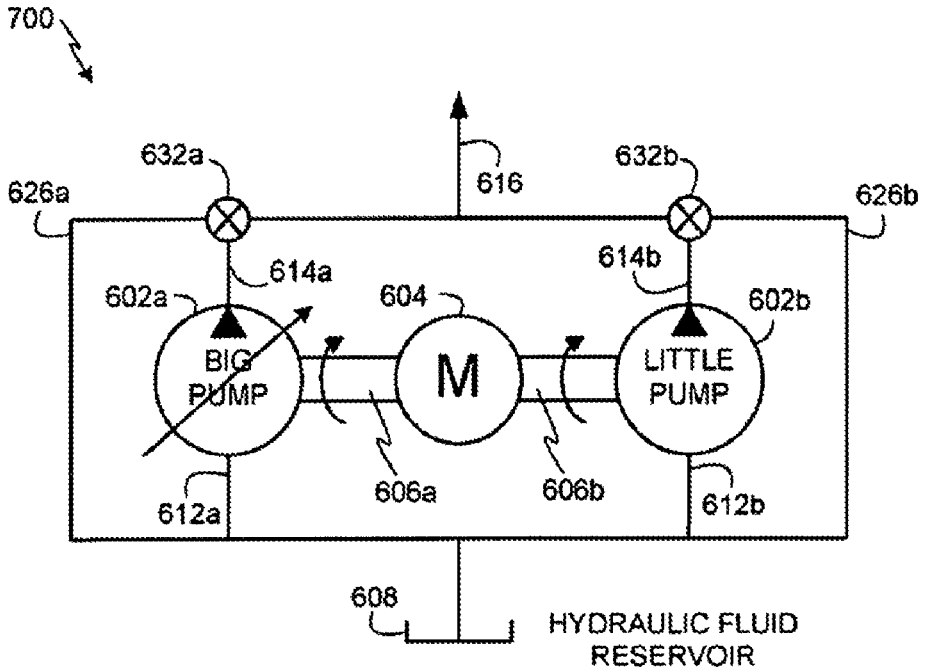
FIG. 7 is a schematic view of a portion of apparatus according to one or more aspects of the present disclosure.

FIG. 7 is a schematic view of another example tandem pump system 700 according to one or more aspects of the present disclosure. The pump system 700 is similar to the pump system 600 shown in FIG. 6, except that the pump system 700 is provided with 3-port, 2-position valves 632*a* and 632*b* instead of the valves 622*a*, 622*b*, 624*a* and 624*b* to control the flow rates and pressures created at the output 616. The valve 632*a* may be coupled between the egress flowline 614*a*, the return flowline 626*a* and the output 616. The valve 632*b* may be coupled between egress flowline 614*b*, the return flowline 626*b* and the output 616. However, those skilled in the art will appreciate that other hydraulic configurations may also be used. For example, the valves 632*a* and 632*b* may be located between the ingress flowline 612*a*, the return flowline 626*a* and the fluid reservoir 608, or between the ingress flowline 612*b*, the return flowline 626*b* and the fluid reservoir 608 respectively. Those having ordinary skill in the art will also appreciate that a 3-port, 2-position valve may be implemented with two 2-port, 2-position valves. Such variations are considered to be within the scope of the present disclosure.

To create a relatively low flow rate at the output 616, a controller (such as the electronics system 502 shown in FIG. 5, the downhole controller 210 shown in FIG. 2 and/or the uphole controller 204 shown in FIG. 2) may: (1) actuate the valve 632*a* corresponding to the big pump 602*a* to fluidly connect the egress flowline 614*a* to the return flowline 626*a* and (2) actuate the valve 632*b* corresponding to the little pump 602*b* to fluidly connect the egress flowline 614*b* to the output 616. In this manner, fluid from the big pump 602*a* may be routed (or re-circulated) via the return flowline 626*a* back to the fluid reservoir 608 and/or the ingress flowline 612*a* such that the big pump 602*a* may not substantially affect the flow rate and the pressure at the output 616. By actuating the valve 632*b* to fluidly couple the egress flowline 614*b* to the output 616, the fluid from the little pump 602*b* may be routed to the output 616 such that the little pump 602*b* may create a relatively low flow rate.

To create a relatively high flow rate, a controller (such as the electronics system 502 shown in FIG. 5, the downhole controller 210 shown in FIG. 2 and/or the uphole controller 204 shown in FIG. 2) may: (1) actuate the valve 632*a* to fluidly connect the egress flowline 614*a* to the output 616 and (2) actuate the valve 632*b* to fluidly connect the egress flowline 614*b* to the return flowline 626*b*, such that fluid from the little pump 602*b* may be routed (or re-circulated) via the return flowline 626*b* back to the reservoir 608 and/or the ingress flowline 612*b*, and fluid from the big pump 602*a* may be routed to the output 616. The valves 632*a* and 632*b* may be opened substantially simultaneously. Moreover, as with the pump system 600 shown in FIG. 6, it should be understood that the pump system 700 is not limited to any particular types of valves, and that other devices capable of selectively varying, restricting, allowing and/or stopping the flow in a flowline are also within the scope of the present disclosure.

In an alternative implementation of the pump system 700, the valve 632*b* and the return flowline 626*b* may be omitted so that fluid pumped by the little pump 602*b* may always be routed to the output 616. When a relatively low flow rate is desired at the output 616, the controller may cause the valve 632*a* to route fluid pumped by the big pump 602*a* away from the output 616 such that the pressure and flow rate at the output 616 may be based on the little pump 602*b*. When a relatively high flow rate is desired, the controller may cause the valve 632*a* to route fluid pumped by the big pump 602*a* to the output 616.

Figure 8:
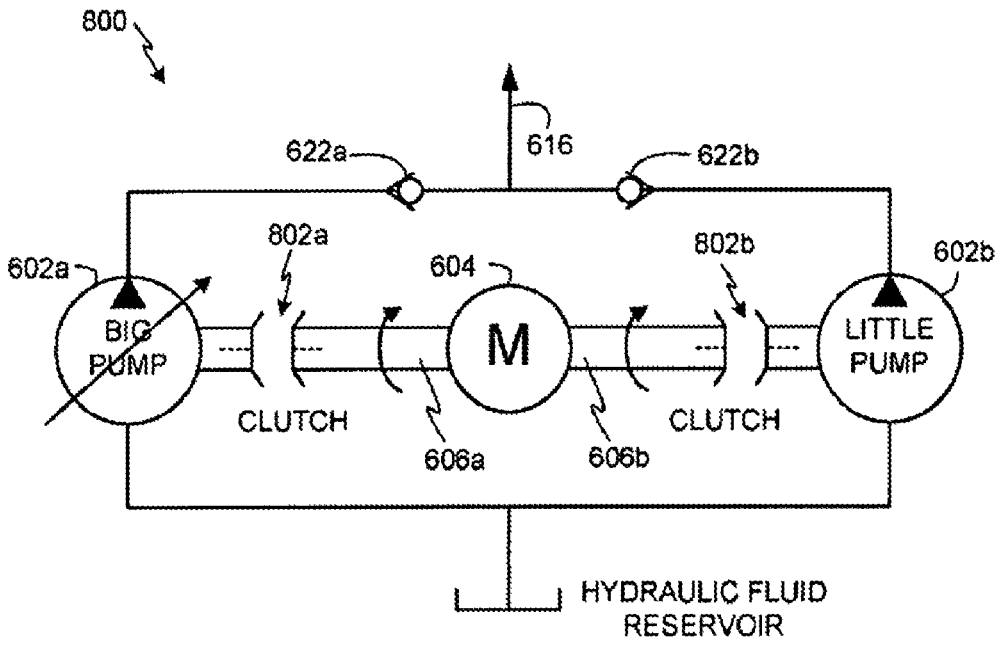
FIG. 8 is a schematic view of a portion of apparatus according to one or more aspects of the present disclosure.

FIG. 8 is a schematic view of another example tandem pump system 800 according to one or more aspects of the present disclosure, demonstrating that a pump system within the scope of the present disclosure may be implemented using clutches 802*a-b*. For example, the motor 604 may be coupled to the big pump 602*a* via the clutch 802*a*, and the motor 604 may be coupled to the little pump 602*b* via the clutch 802*b*. Consequently, valves (such as the valves 622*a*, 622*b*, 624*a*, 624*b*, 632*a* and 632*b* of FIGS. 6 and 7) may not be required for controlling flow rates and pressures. Instead, a controller (such as the electronics system 502 shown in FIG. 5, the downhole controller 210 shown in FIG. 2 and/or the uphole controller 204 shown in FIG. 2) may be configured to selectively control (hydraulically or mechanically) the actuation of the clutches 802*a-b* to control or regulate the flow rates at the output 616. For example, to create a relatively high flow rate at the output 616, the controller may: (1) selectively enable or engage the clutch 802*a* corresponding to the big pump 602*a* and (2) selectively disable or disengage the clutch 802*b* corresponding to the little pump 602*b*. To create a relatively low flow rate at the output 616, the controller may: (1) selectively enable or engage the clutch 802*b* and (2) selectively disable or disengage the clutch 802*a*. The controller may be configured to engage the clutches 802*a* and 802*b* substantially simultaneously, thus operating the pumps 602*a* and 602*b* substantially simultaneously to combine the fluid pumped by the pumps 602*a* and 602*b* at the output 616. In such embodiments, check vales 622*a* and 622*b* may be desired between the output 616 and both of the pumps 602*a* and 602*b*.

The pump system 800 shown in FIG. 8 may be more efficient than the pump system 600 shown in FIG. 6. That is, the motor 604 of the pump system 7800 may not need to actuate both of the pumps 602*a* and 602*b* simultaneously, as may be done in connection with the pump system 600.

In an alternate implementation, the motor 604 may be coupled to the big pump 602*a* via the clutch 802*a* and the motor 604 may be coupled to the little pump 602*b* via the shaft 606*b*. A check valve similar to valve 602*a* may be desirable. The controller may be configured to selectively control (hydraulically or mechanically) the actuation of the clutch 802*a* to control or regulate the flow rates at the output 616. For example, to create a relatively high now rate at the output 616, the controller may selectively enable or engage the clutch 802*a* corresponding to the big pump 602*a*. To create a relatively low flow rate at the output 616, the controller may selectively disable or disengage the clutch 802*a*.

The pump systems 600, 700 and 800 shown in FIGS. 6, 7 and 8 may be combined within the scope of the present disclosure. For example, a pump system may be achieved by combining a clutch such as clutch 802*a*, a valve such as valve 632*b* and a return flowline such as flowline 626*b*. This and similar combinations are also within the scope of the present disclosure.

Figure 9:
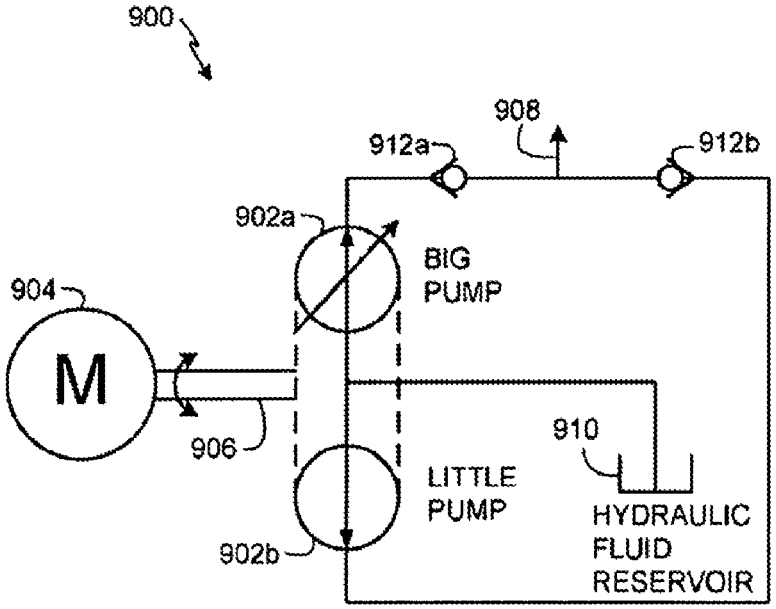
FIG. 9 is a schematic view of a portion of apparatus according to one or more aspects of the present disclosure.

FIG. 9 is a schematic view of an example two-headed pump system 900 according to one or more aspects of the present disclosure. The pump system 900 comprises two pumps 902*a* and 902*b*, as well as a motor 904 having a shaft 906 coupled to the pumps 902*a* and 902*b*. The pumps 902*a* and 902*b* may be unidirectional pumps. The pumps 902*a* and 902*b* may be configured to force fluid between a pump inlet and a pump outlet when driven in a first direction, and the pumps 902*a* and 902*b* may not be active and thus may not circulate fluid when driven in a second opposite direction. The pumps 902*a* and 902*b* may be implemented using a dual-pump unit assembled in a single package. That is, the pumps 902*a* and 902*b* may be coupled to the shaft 906 such that when the shaft rotates in the clockwise direction, for example, the pump 902*a* is driven in the first direction and the pump 902*b* is simultaneously driven in the second direction. In a manner similar to that described above, the pump 902*a* may be implemented as a "big" pump and the pump 902*b* may be implemented as a "little" pump. However, the pumps 902*a* and 902*b* may be coupled to the shaft 906 such that when the shaft 906 rotates in the counter-clockwise direction, the pump 902*a* is driven in the first direction and the pump 902*b* is simultaneously driven in the second direction.

The direction of rotation of the motor 904 may control the flow rates and pressures created at an output 908 of the pump system 900. To create a relatively high flow rate, a controller (such as the electronics system 502 shown in FIG. 5, the downhole controller 210 shown in FIG. 2 and/or the uphole controller 204 shown in FIG. 2) may cause the motor 904 to rotate in a clockwise direction to actuate the big pump 902*a* so that the big pump 902*a* pumps hydraulic fluid from a reservoir 910 to the output 908. To create a relatively low flow rate, the controller may cause the motor 904 to rotate in a counter-clockwise direction to actuate the little pump 902*b* so that the little pump 902*b* pumps hydraulic fluid from the reservoir 910 to the output 908. A check valve 912*a* may be provided between the big pump 902*a* and the output 908 to prevent fluid pumped by the little pump 902*b* from flowing into the output port of the big pump 902*a*. A check valve 912*b* may be provided between the little pump 902*b* and the output 908 to prevent fluid pumped by the big pump 902*a* from flowing into the output port of the little pump 902*b*.

Figure 10:
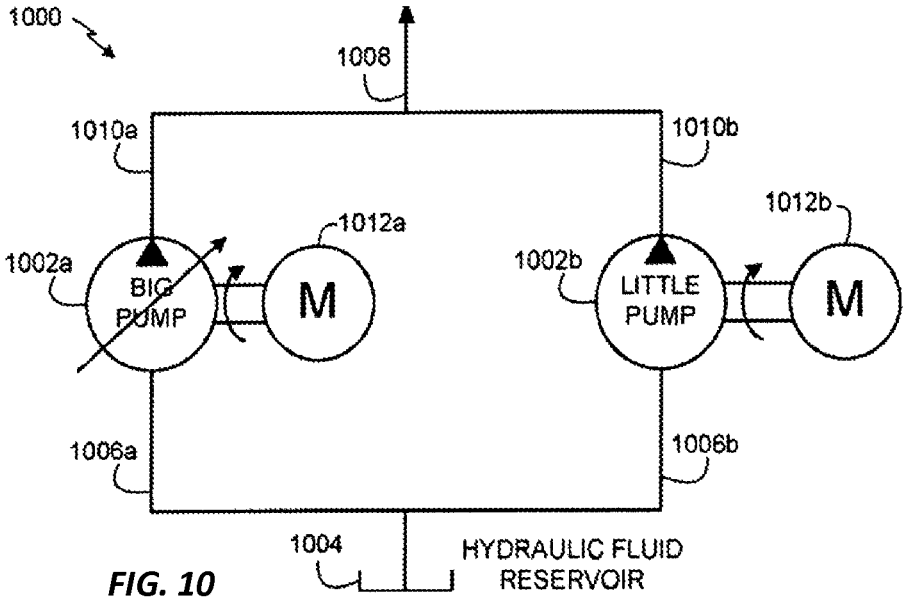
FIG. 10 is a schematic view of a portion of apparatus according to one or more aspects of the present disclosure.

FIG. 10 is a schematic view of an example dual-motor pump system 1000 according to one or more aspects of the present disclosure. The pump system 1000 comprises a big pump 1002*a* and a little pump 1002*b*. The big pump 1002*a* draws hydraulic fluid from a hydraulic fluid reservoir 1004 via an ingress flowline 1006*a* and pumps the fluid to an output 1008 via an egress flowline 1010*a*. The little pump 1002*b* draws hydraulic fluid from the reservoir 1004 via an ingress flowline 1006*b* and pumps the fluid to the output 1008 via an egress flowline 1010*b*. The pump system 1000 also comprises a first motor 1012*a* coupled to the big pump 1002*a*, and a second motor 1012*b* coupled to the little pump 1002*b*. A controller (such as the electronics system 502 shown in FIG. 5, the downhole controller 210 shown in FIG. 2 and/or the uphole controller 204 shown in FIG. 2) may be configured to selectively enable or actuate the motors 1012*a* and 1012*b* to actuate the pumps 1002*a* and 1002*b* to control the flow rates and pressures at the output 1008. For example, to create a relatively high flow rate and a relatively low fluid pressure, the controller may selectively actuate, activate or otherwise cause the motor 1012*a* to rotate to actuate the big pump 1002*a* and selectively deactivate or otherwise stop rotation of the motor 1012*b*, such that the big pump 1002*a* may pump hydraulic fluid from the reservoir 1004 to the output 1008. To create a relatively low flow rate and a relatively high fluid pressure, the controller may selectively actuate, activate or otherwise cause the motor 1012*b* to rotate to actuate the little pump 1002*b* and selectively deactivate or otherwise stop rotation of the motor 1012*a*, such that the little pump 1002*b* may pump hydraulic fluid from the reservoir 1004 to the output 1008. In some example implementations, the controller may be configured to cause both of the motors 1012*a* and 1012*b* to rotate to vary the pressure and flow rate at the output 1008 by varying the amount of fluid pumped by each of the pumps 1002*a* and 1002*b* to the output 1008.

Figure 11:
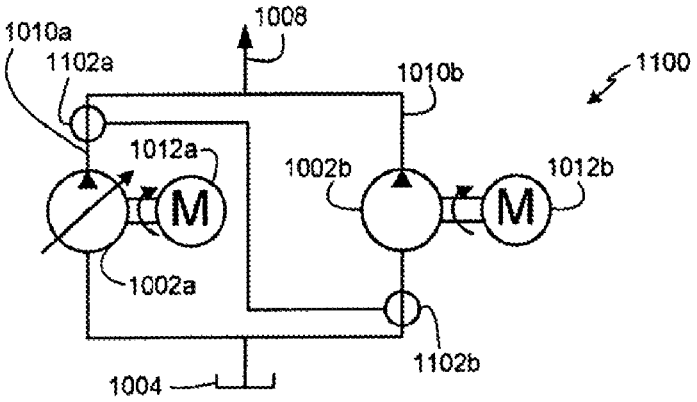
FIG. 11 is a schematic view of a portion of apparatus according to one or more aspects of the present disclosure.
Figure 12:
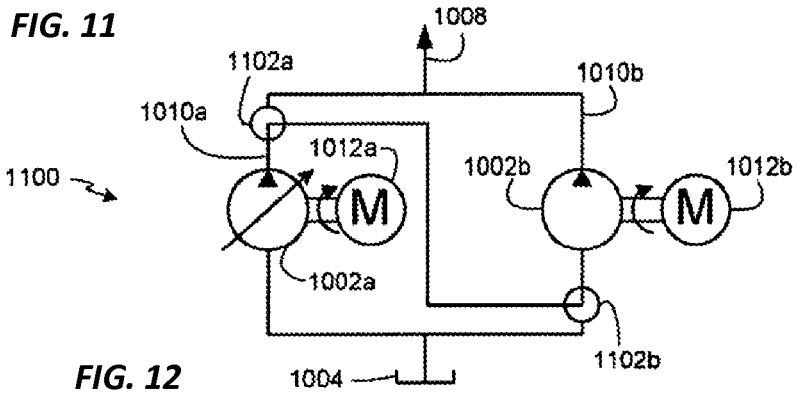
FIG. 12 is a schematic view of a portion of apparatus according to one or more aspects of the present disclosure.

Turning to FIGS. 11 and 12, an example parallel/series pump system 1100 is depicted in a parallel-pumping mode (FIG. 11) and a series-pumping mode (FIG. 12). The example pump system 1100 may be utilized to increase the maximum pressure and maximum flow rate above the output characteristics of a single pump system. To achieve a maximum flow rate, the pump system 1100 may be configured in the parallel-pumping mode depicted in FIG. 11. To achieve a lower flow rate (and a maximum pressure differential between the outlet and the reservoir), the pump system 1100 may be configured in the series-pumping mode depicted in FIG. 12.

The pump system 1100 may be implemented with 3-port, 2-position valves 1102*a* and 1102*b* to the dual-motor pump system 1000 shown in FIG. 10. That is, the valve 1102*a* may be connected in line with the egress flowline 1010*a* that fluidly couples an output of the pump 1002*a* to the output 1008, and the valve 1102*b* may be connected in line with the ingress flowline 1106*b* that fluidly couples an input of the pump 1002*b* to the reservoir 1004. A controller (such as the electronics system 502 shown in FIG. 5, the downhole controller 210 shown in FIG. 2 and/or the uphole controller 204 shown in FIG. 2) may be configured to actuate the valves 1102*a* and 1102*b* to selectively configure the pump system 1100 to operate in the parallel-pumping mode or the series-pumping mode. For example, to implement the parallel-pumping mode as shown in FIG. 11, the controller may: (1) actuate the valve 1102*a* corresponding to the pump 1002*a* to fluidly connect the output of the big pump 1002*a* (e.g., the egress flowline 1010*a*) to the output 1008 and (2) actuate the valve 1102*b* corresponding to the pump 1002*b* to fluidly connect the reservoir 1004 to the input of the little pump 1002*b*. In this manner, both of the pumps 1002*a* and 1002*b* may draw fluid from the reservoir 1004 and pump the fluid to the output 1008. In the parallel-pumping mode, if the big pump 1002*a* is set to displace 1.2 gallons per minute (gpm) and the little pump 1002*b* is set to displace 0.8 gpm, the total flow rate at the output 1008 is 2.0 gpm (i.e., 1.2 gpm+0.8 gpm=2.0 gpm).

To implement the series-pumping mode as shown in FIG. 12, the controller may actuate the valves 1102*a* and 1102*b* to fluidly connect the output of the pump 1002*a* (e.g., the egress flowline 1010*a*) to the input of the pump 1002*b*. In this manner, the fluid pumped by the pump 1002*a* may be output to the input of the pump 1002*b* and the pump 1002*b* may pump the fluid to the output 1008. In the series-pumping mode, if the input pressure to the pump 1002*a* (i.e., the pressure of the reservoir 1004) is 4000 pounds per square inch (PSI), the pump 1002*a* is set to pump at 2500 PSI, and the pump 1002*b* is set to pump at 3000 PSI, then the total pressure at the output 1008 is 9500 PSI (i.e., 4000 PSI+2500 PSI+3000 PSI=9500 PSI). The pressure difference between the hydraulic fluid in the reservoir 1004 and the output 1008 is 5500 PSI (i.e., 9500 PSI−4000 PSI=5500 PSI).

Both of the pumps 1002*a* and 1002*b* may be implemented using variable displacement pumps, or both of the pumps 1002*a* and 1002*b* may be implemented using fixed displacement pumps. Alternatively, the pump 1002*a* may be a variable displacement pump and the pump 1002*b* may be a fixed displacement pump, or the pump 1002*a* may be a fixed displacement pump and the pump 1002*b* may be a variable displacement pump. In another example, one of the two motors 1012*a* and 1012*b* of FIGS. 11 and 12 may be implemented, and both pumps 1002*a* and 1002*b* in FIGS. 11 and 12 may be driven by a single shaft that is mechanically coupled to a single motor.

Figure 13:
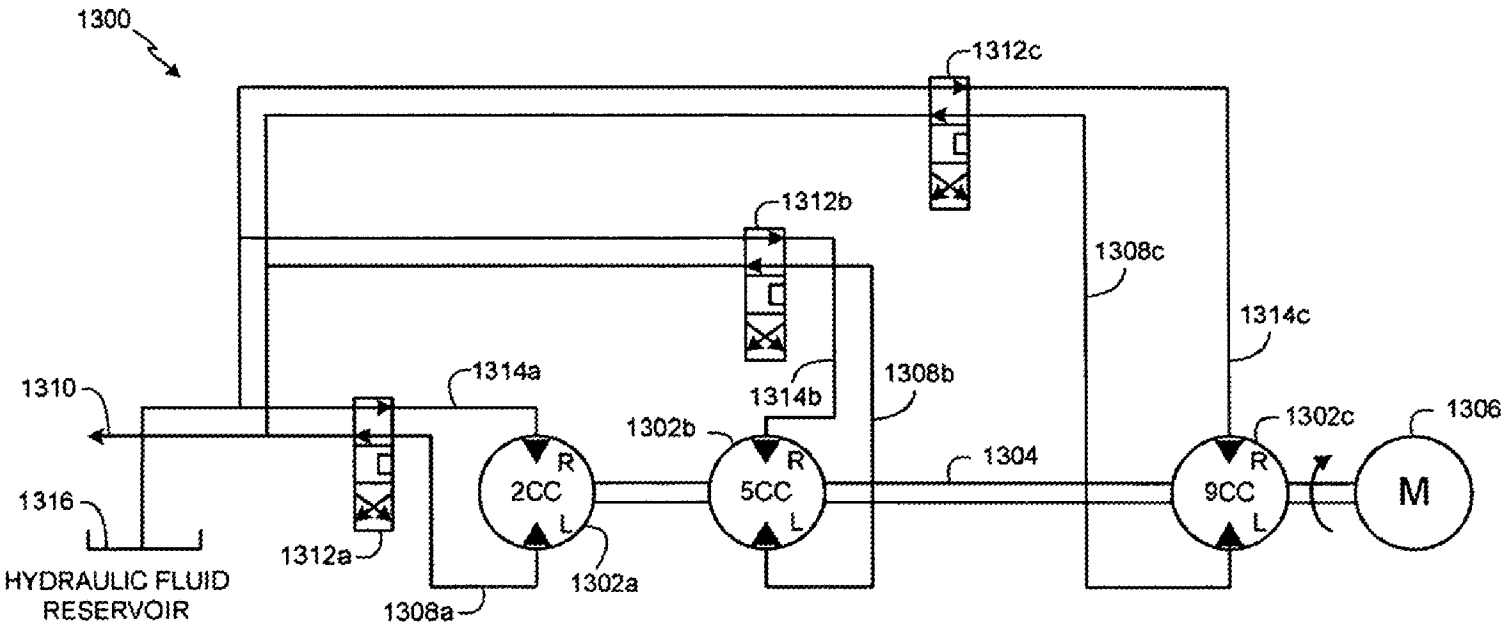
FIG. 13 is a schematic view of a portion of apparatus according to one or more aspects of the present disclosure.

FIG. 13 is a schematic view of an example three-stage pump system 1300 according to one or more aspects of the present disclosure. The pump system 1300 comprise three pumps 1302*a*, 1302*b* and 1302*c* driven by a common shaft 1304 of a motor 1306. As the motor 1306 rotates, the shaft 1304 drives all of the pumps 1302*a*, 1302*b* and 1302*c* simultaneously, and the pumps 1302*a*, 1302*b* and 1302*c* continuously pump fluid out via respective egress flowlines 1308*a*, 1308*b* and 1308*c*. The three-stage pumping system 1300 may be utilized to vary the flow rate at an output 1310 by selectively enabling or disabling (e.g., connecting or short circuiting) each of the egress flowlines 1308*a*, 1308*b* and 1308*c* of the pumps 1302*a*, 1302*b* and 1302*c*. To enable or disable fluid flow via the egress flowlines 1308*a*, 1308*b* and 1308*c*, the pumping system 1300 may comprise three directional control valves 1312*a*, 1312*b* and 1312*c* fluidly connected in line with respective ones of the egress flowlines 1308*a*, 1308*b* and 1308*c* between respective pump outputs and the output 1310 of the pumping system 1300. The directional control valves 1312*a*, 1312*b* and 1312*c* may also be fluidly connected in line with ingress flowlines 1314*a*, 1314*b* and 1314*c* that fluidly couple inputs of the pumps 1302*a*, 1302*b* and 1302*c* to a hydraulic fluid reservoir 1316. In the illustrated example, the pumps 1302*a*, 1302*b* and 1302*c* are implemented using different displacement sizes, wherein the pump 1302*a* is a 2 CC pump, the pump 1302*b* is a 5 CC pump and the pump 1302*c* is a 9 CC pump. However, in other examples within the scope of the present disclosure, the pumps 1302*a*, 1302*b* and 1302*c* may be implemented using other displacement sizes and/or the pumps 1302*a*, 1302*b* and 1302*c* may each have the same displacement.

To vary the fluid pressure and the fluid flow rate at the output 1310, a controller (such as the electronics system 502 shown in FIG. 5, the downhole controller 210 shown in FIG. 2 and/or the uphole controller 204 shown in FIG. 2) may be configured to open and close the valves 1312*a*, 1312*b* and 1312*c* to utilize the work performed by one of the pumps 1302*a* or to combine the work performed by one or more of the pumps 1302*a*, 1302*b* and 1302*c*. For example, to create a relatively low flow rate at the output 1310, the controller may manipulate the valves 1312*b* and 1312*c* to disable fluid output from the 5 CC pump 1302*b* and the 9 CC pump 1302*c* and open the valve 1302*a* to allow fluid pumped by the 2 CC pump 1302*a* to flow to the output 1310. To increase the flow rate and decrease the pressure at the output 1310, the controller may enable fluid flow to the output 1310 from one of the larger pumps 1302*b* and/or 1302*c*, or a combination of the pumps 1302*a*, 1302*b* and 1302*c*.

Figure 14:
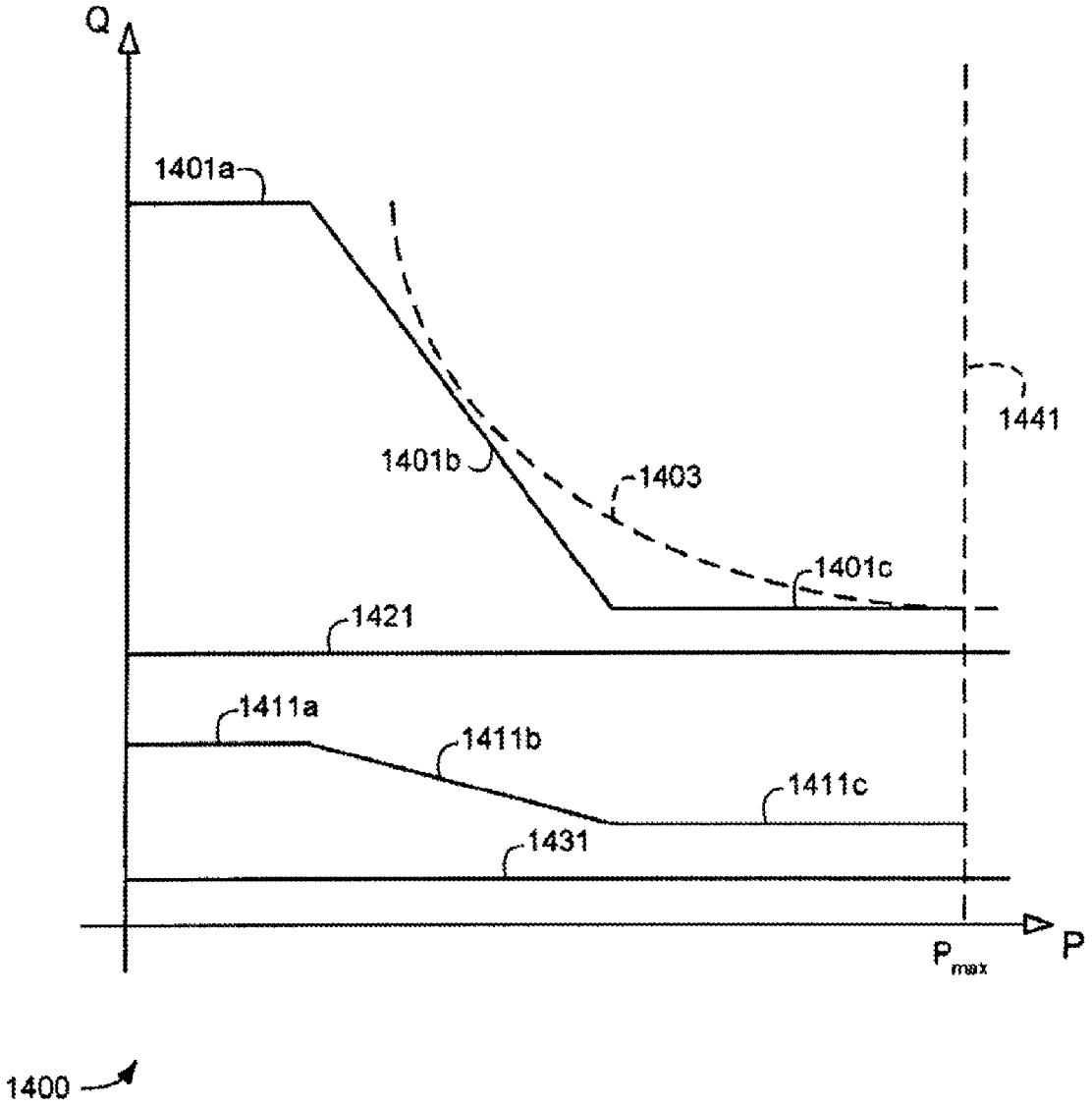
FIG. 14 is a graph demonstrating one or more aspects of the present disclosure.

FIG. 14 is a graph 1400 illustrating the operating envelope for a pump system according to one or more aspects of the present disclosure. The graph 1400 represents fluid volumetric flow rate (y-axis) versus operating pressure (x-axis) for an example pump system within the scope of the present disclosure, such as the pump system 900 shown in FIG. 9. The graph 1400 also represents fluid flow rates and pressure differentials at which two pumps of the pump system may operate. The operating envelopes of the various pump systems disclosed herein are not, however, limited to the particular depiction of FIG. 14. That is, the graph 1400 is provided for illustration purposes only, such that other pump system envelopes are also within the scope of the present disclosure.

The graph 1400 illustrates a curve comprising portions 1401*a*, 1401*b* and 1401*c* that collectively represent maximum flow rate versus pressure that may be achieved by a first pump of the pump system (such as the big pump 902*a* shown in FIG. 9). The curve portion 1401*a* corresponds to a constant flow limitation, which may be deducted from the maximum rotational speed of the pump (such as may preserve the lifespan of the pump). The curve portions 1401*b* and 1401*c* are dictated by a constant power limitation 1403, which may be deducted from the power available to the pump system in the downhole tool (such as the BHA 100 shown in FIG. 1, the downhole tool 200 shown in FIG. 2, and/or the downhole tool 300 shown in FIG. 3). The curve portions 1401*b* and 1401*c* may closely match the dashed curve 1403, indicating the constant power limitation. However, in the illustrated embodiment, the curve portions 1401*b* and 1401*c* deviate from the curve 1403. That is, the curve portion 1401*b* corresponds to a variable displacement range, and the curve portion 1401*c* corresponds to a fixed displacement range.

For most variable displacement pumps, the pump displacement (expressed in cubic centimeters (CC) per revolution) may be varied with the differential pressure (on the x-axis). The pump system and/or another portion of the downhole tool may comprise a sensor that may be utilized for measuring the pressure differential across the pump. This measurement may be utilized in a feedback loop to adjust the pump displacement. For example, the displacement of the pump may be varied by adjusting an angle of a swashplate of the pump. In the example of FIG. 14, the swashplate angle is reduced from a maximum angle to a minimum angle along the curve portion 1401*b*. The swashplate angle remains at the minimum angle along the curve portion 1401*c*. Of course, other control strategies may be alternatively be utilized, and the curve collectively represented by curve portions 1401*a*, 1401*b* and 1401*c* may differ from the illustrated example.

The graph 1400 also illustrates a curve comprising portions 1411*a*, 1411*b* and 1411*c* that represents the minimum flow rate versus pressure that may be achieved by the first pump. The curve portion 1411*a* corresponds to a constant flow limitation, which may be deducted from the minimal rotational speed of the big pump (such as the big pump 902*a* shown in FIG. 9), such as may aid in avoiding stalling of the pump. The curve portions 1411*b* and 1411*c* corresponds to the pump displacement variations (e.g., the swashplate angle) resulting to the pressure differential across the pump. However, as mentioned above, the big pump may be configured to operate at relatively high flow rates.

The graph 1400 also illustrates a curve 1421 that represents the maximum flow rate versus pressure that may be achieved by a second pump (such as the little pump 902*b* shown in FIG. 9). As shown, the second pump may operate within the power limits available in the downhole tool, and may be limited only by its maximum rotational speed. The curve 1431 represents the minimum flow rate versus pressure that may be achieved by the first pump. The curve 1431 corresponds to a constant flow limitation, which may be deducted from the minimal rotational speed of the second pump. The graph 1400 also illustrates a curve 1441 that represents a maximum differential pressure for the pumps.

The operating envelope of the pump system may span from low flow rates above the curve 1431 to high flow rates below the curve portions 1401*a*, 1401*b* and 1401*c*, thus covering a larger range of flow rates than the first or second pump ranges alone. In particular, if a flow rate lower than the limit indicated by the curve portions 1411*a*, 1411*b* and 1411*c* is desired, the little pump may be enabled by rotating the motor in the direction associated with the little pump. If a flow rate higher than the limit indicated by the curve 1421 is desired, the big pump may be enabled by rotating the motor in the direction associated with the big pump. For intermediate flow rates, any of the big or little pumps may be utilized.

Figure 15:
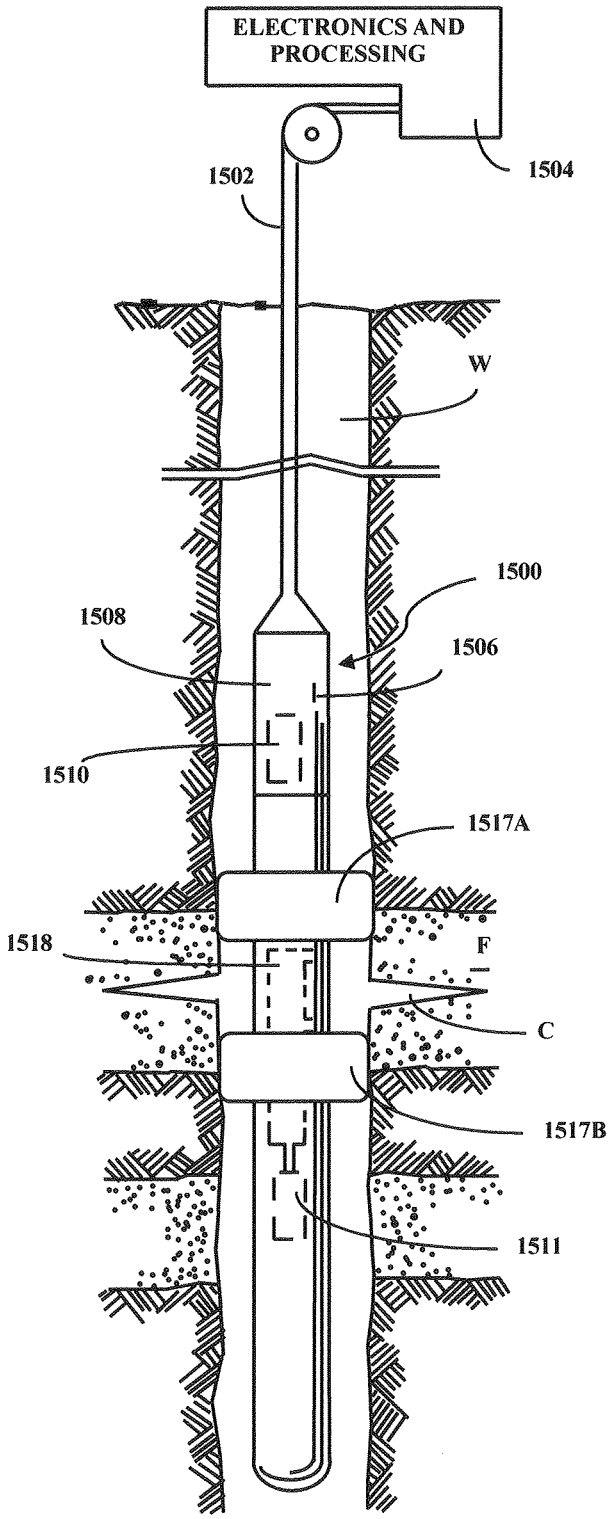
FIG. 15 is a schematic view of at least a portion of apparatus according to one or more aspects of the present disclosure.

FIG. 15 is a schematic view of another example downhole tool 1500 within the scope of the present disclosure. The downhole tool 1500 may be substantially similar to the downhole tools described above. For example, the downhole tool 1500 may be substantially identical to the other downhole tools described above except for the features described below. Similarly, the features described below with respect to the downhole tool 1500 may be applicable or readily adaptable to the other downhole tools described above. To that end, like the other downhole tools described above, the downhole tool 1500 may be utilized to first initiate and then propagate a fracture C in the subterranean formation F.

The downhole tool 1500 may be suspended in the wellbore W from the lower end of a multi-conductor cable 1502 that is spooled on a winch (not shown) at the Earth's surface. At the surface, the cable 1502 may be communicatively coupled to electronics and processing equipment and/or another type of control system 1504. Of course, embodiments within the scope of the present disclosure are not limited to the wireline embodiment shown in FIG. 15, and may also comprise embodiments implemented for drilling or tough-logging-conditions (TLC) wherein the downhole tool 1500 may be suspended in the wellbore W via a series of drill-pipe segments and/or other substantially rigid tubulars. Similarly, embodiments in which the downhole tool 1500 is suspended in the wellbore W via coiled tubing, slickline and/or other means for conveyance within the wellbore W are also within the scope of the present disclosure.

The downhole tool 1500 comprises an elongated body 1506 that includes a control module 1508 having a downhole portion of a tool control system 1510 configured to control an example pump system 1511. The pump system 1511 may be substantially similar or otherwise have one or more aspects in common with the other pump systems described above. The pump system 1511 may be utilized to pump hydraulic fluid at different fluid flow rates and pressures to first initiate and then propagate fractures C within the subterranean formation F. The control system 1510 may also be configured to analyze and/or perform other measurements.

The elongated body 1506 also comprises inflatable external packer elements 1517, which may be utilized to seal off or isolate selected portions of the wellbore W, such that the isolated portion of the wellbore W may be pressurized via the pump system 1511 to initiate and propagate the fractures C. The downhole tool 1500 also comprises a fluid analysis module 1518, which may be utilized to collect fluid pressure and other data to measure properties of the subterranean formation F and the newly created fractures C. Such data may be utilized, for example, to control pump output during the fracture initiation and/or propagation process.

Figure 16:
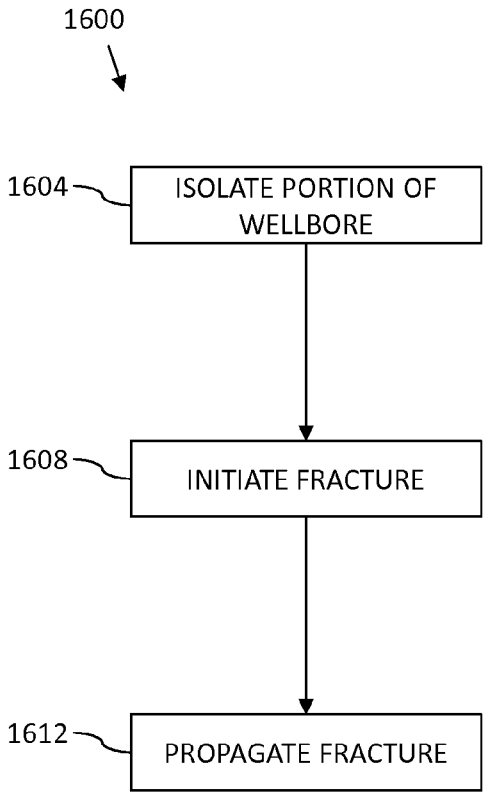
FIG. 16 is a flow-chart diagram of at least a portion of a method according to one or more aspects of the present disclosure.

FIG. 16 is a flow-chart diagram of at least a portion of a method 1600 to initiate and propagate fractures in a subterranean formation according to one or more aspects of the present disclosure. The method 1600 may be executed by apparatus substantially similar to those described above or otherwise having one or more aspects in common with the apparatus described above or otherwise within the scope of the present disclosure. However, for the sake of clarity, and without limiting the scope of the method 1600 or any other portion of the present disclosure, the method 1600 is described below in reference to the downhole tool 1500 shown in FIG. 15. That is, while the method 1600 is described below in relation to the downhole tool 1500 shown in FIG. 15, the method 1600 may also be applicable or readily adaptable to any downhole tool comprising first and second hydraulic pumps that have substantially different operating pressures and flow rates, among other possibly different characteristics. The first and second pumps may be fixed and/or variable displacement as desired, for example, to optimize efficiency during operation. In an example embodiment, the first pump may be a fixed displacement pump utilized to initiate fractures C in the formation F, and the second pump may be a variable displacement pump utilized to propagate the fractures C in the formation F. The first and second pumps may be operatively coupled to at least one motor within the downhole tool. The pumps may be utilized in tandem such that the second pump accounts for the flow rates of the first and second pumps and produces a combined output pressure of the first and second pumps.

Thus, referring to both FIGS. 15 and 16, the method 1600 comprises a step 1604 during which a portion of the wellbore W may be isolated from the remainder of the wellbore W. For example, external packer elements 1517A and 1517B may be inflated to create a seal between at least a portion of the downhole tool 1500 and the subterranean formation F. Alternatively, or additionally, step 1604 may comprise hydraulically or otherwise extending one or more probes from the downhole tool 1500 to contact and form a seal against the subterranean formation F. The one or more probes may be substantially similar or identical to the probe 152 shown in FIG. 1, the probe assemblies 412, 414 and/or 416 shown in FIG. 4, and/or the probes 501*a* and/or 501*b* shown in FIG. 5. Alternatively, or additionally, the step 1604 may comprise hydraulically or otherwise extending one or more backup pistons from one side of the downhole tool 1500 such that one or more non-extendable probes and/or other outlets on an opposite side of the downhole tool 1500 may be pressed into sealing engagement with the sidewall of the wellbore W. The one or more non-extendable probes and/or other outlets may be substantially similar or identical to the outlet 312 shown in FIG. 3. However, other techniques to isolate a portion of the wellbore W during step 1604 are also within the scope of the present disclosure.

A fracture C may then be initiated in the formation F during a step 1608 by pumping hydraulic fluid into formation F via the isolated portion of the wellbore W using the first pump of the downhole tool 1500. The first pump may yield substantially greater pressure than the second pump, and/or the first pump may yield substantially lower flow rate than the second pump.

After the fracture C is initiated during step 1608, the method 1600 continues to a step 1612 during which the fracture C is propagated further into the formation F. For example, the second pump may now be employed to pressurize the isolated portion of the wellbore W at a pressure that may be substantially lower than had been used by the first pump to create the fracture C, and/or at a flow rate that may be substantially higher than had been used by the first pump to create the fracture C.

Figure 17:
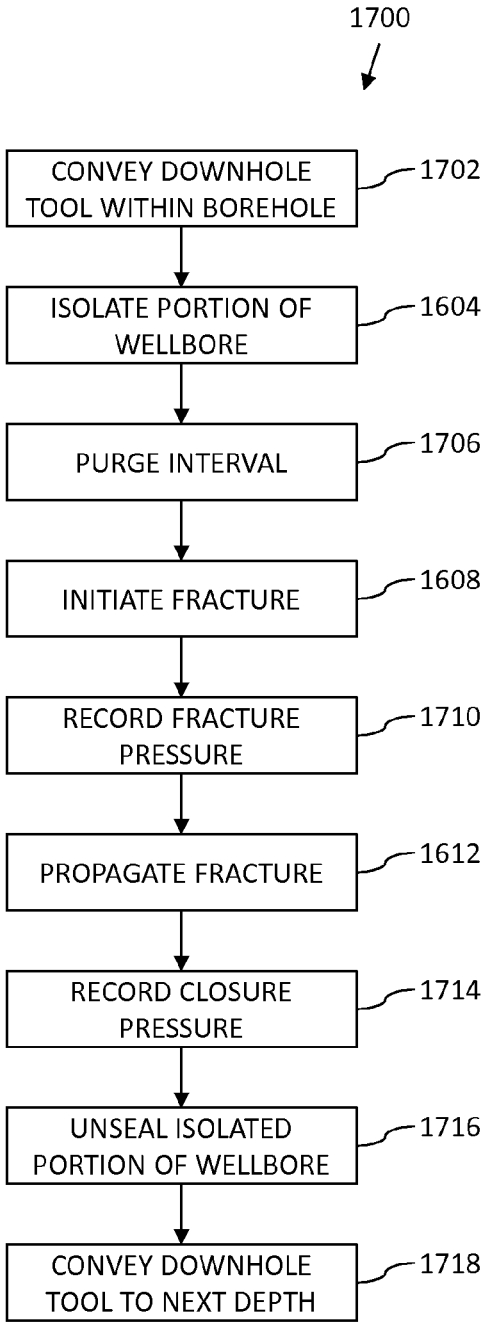
FIG. 17 is a flow-chart diagram of at least a portion of a method according to one or more aspects of the present disclosure.

FIG. 17 is a flow-chart diagram of at least a portion of a variation of the method 1600 shown in FIG. 16, herein designated by reference numeral 1700. That is, the method 1700 is an example implementation of the method 1600 shown in FIG. 16, such that the method 1700 comprises the steps 1604, 1608 and 1612 described above. However, the method 1700 is illustrated in FIG. 17 as comprising additional steps relative to those illustrated for the method 1600 shown in FIG. 16, although this is not intended to indicate that the method 1600 cannot include any of the additional steps shown in FIG. 17. Rather, the method 1700 shown in FIG. 17 is merely an example of the method 1600 shown in FIG. 16, and is presented herein to demonstrate that the method 1600 may comprise additional steps other than the three steps 1604, 1608 and 1612 illustrated in FIG. 16.

Accordingly, like the method 1600 shown in FIG. 16, the method 1700 shown in FIG. 17 may be executed by apparatus substantially similar to those described above or otherwise having one or more aspects in common with the apparatus described above or otherwise within the scope of the present disclosure. Similarly, for the sake of clarity but without limiting the scope of the method 1700, the method 1700 is described below in reference to the downhole tool 1500 shown in FIG. 15. While the method 1700 is described below in relation to the downhole tool 1500 shown in FIG. 15, the method 1700 may also be applicable or readily adaptable to any downhole tool comprising first and second hydraulic pumps that have substantially different operating pressures and flow rates, among other possibly different characteristics. The first and second pumps may be fixed and/or variable displacement as desired, for example, to optimize efficiency during operation. In an example embodiment, the first pump may be a fixed displacement pump utilized to initiate fractures C in the formation F, and the second pump may be a variable displacement pump utilized to propagate the fractures C in the formation F. The first and second pumps may be operatively coupled to at least one motor within the downhole tool. The pumps may be utilized in tandem such that the second pump accounts for the flow rates of the first and second pumps and produces a combined output pressure of the first and second pumps.

Thus, referring to both FIGS. 15 and 17, the method 1700 comprises a step 1702 during which the downhole tool 1500 is conveyed to a desired depth within the wellbore W. Once positioned, the remainder of the method 1700 to initiate and propagate fractures in the subterranean formation F may or may not require repositioning of the downhole tool 1500 within the wellbore W.

After the downhole tool 1500 is conveyed to the desired depth, a portion of the wellbore W is isolated during step 1604, as described above. The method 1700 also comprises a step 1706 during which the sealed portion of the wellbore W may undergo one or more cleanup operations. For example, step 1706 may comprise pumping formation fluid, drilling fluid and/or other fluids out of the isolated portion of the wellbore W using at least one of the pumps of the downhole tool 1500.

A fracture C is then initiated in the formation F during step 1608, as described above, by pumping hydraulic fluid using the first pump of the downhole tool 1500. While the first pump is being operated to initiate a fracture during step 1608, the pressure in the sealed interval may be continuously measured and monitored. The creation of a new fracture C in the formation F may result in a decrease in pressure within the isolated portion of the wellbore W (as measured by one or more sensors of the downhole tool 1500) due to hydraulic fluid escaping the sealed portion of the wellbore W into the newly created fracture(s) C and/or other areas of the subterranean formation F. Thus, the method 1700 may also comprise a step 1710 during which such "fracture pressure" may be recorded. Moreover, the first pump may be stopped once the fracture is detected, and the profile of the ensuing pressure decrease in the sealed portion of the wellbore W may be recorded for future use. By way of example only, this data may be useful to update any existing geological models of the subterranean formation F. The information may also or alternatively be utilized in combination with drilling logs to predict drilling parameters for subsequent drilling operations, whether at the existing wellsite or in other geographic locations with, perhaps, similar geological characteristics.

After the fracture C is initiated during step 1608, and after the fracture pressure and the ensuing pressure decrease are recorded in step 1710, the method 1700 continues to step 1612 during which the fracture C is propagated further into the formation F, as described above. For example, the second pump may now be employed to pressurize the isolated portion of the wellbore W at a pressure that may be substantially lower than had been used by the first pump to create the fracture C, and/or at a flow rate that may be substantially higher than had been used by the first pump to create the fracture C.

During a subsequent step 1714, the "closure pressure" at which the fracture C begins to close may be measured and recorded. During subsequent step 1716, the pressure within the isolated portion of the wellbore W may be equalized relative to the pressure within the wellbore W and/or the pore pressure of the formation F, and the isolated portion of the wellbore W may thus be unsealed. For example, one or more pumps of the downhole tool 1500 may be operated to pump fluid out of the isolated portion of the wellbore W, perhaps into the non-isolated portion of the wellbore W. Unsealing the isolated portion of the wellbore W may, for example, comprise pumping fracture fluid and/or other fluids from the isolated portion of the wellbore W. If the packer elements 1517A and 1517B were utilized to seal the isolated portion of the wellbore W during step 1604, then step 1716 may also comprise deflating the packer elements 1517A and 1517B. If any probes and/or backup pistons were utilized to seal the isolated portion of the wellbore W during step 1604, then step 1716 may also comprise hydraulically retracting such probes and/or backup pistons.

The method 1700 may also comprise a step 1718 during which the downhole tool 1500 may be conveyed to another desired depth such that, for example, one or more portions of the method 1700 may be repeated to initiate and propagate additional fractures in the subterranean formation F at a different station within the wellbore W. Alternatively, the downhole tool 1500 may merely be retrieved to the surface.

The present disclosure introduces aspects of hydraulically fracturing a subterranean formation via a wireline-conveyed downhole tool comprising first and second pumps and at least one motor for driving the first and second pumps. One or more of such aspects may broaden the potential range of operation during such fracturing, such as may be utilized to initiate and propagate fractures in high strength and/or permeability formations. Additionally, the dual hydraulic pump configuration may allow better system optimization, such as where the pumping system of the downhole tool may be implemented with the freedom to selectively operate at the high efficiency zone of each pump.

Figure 18:
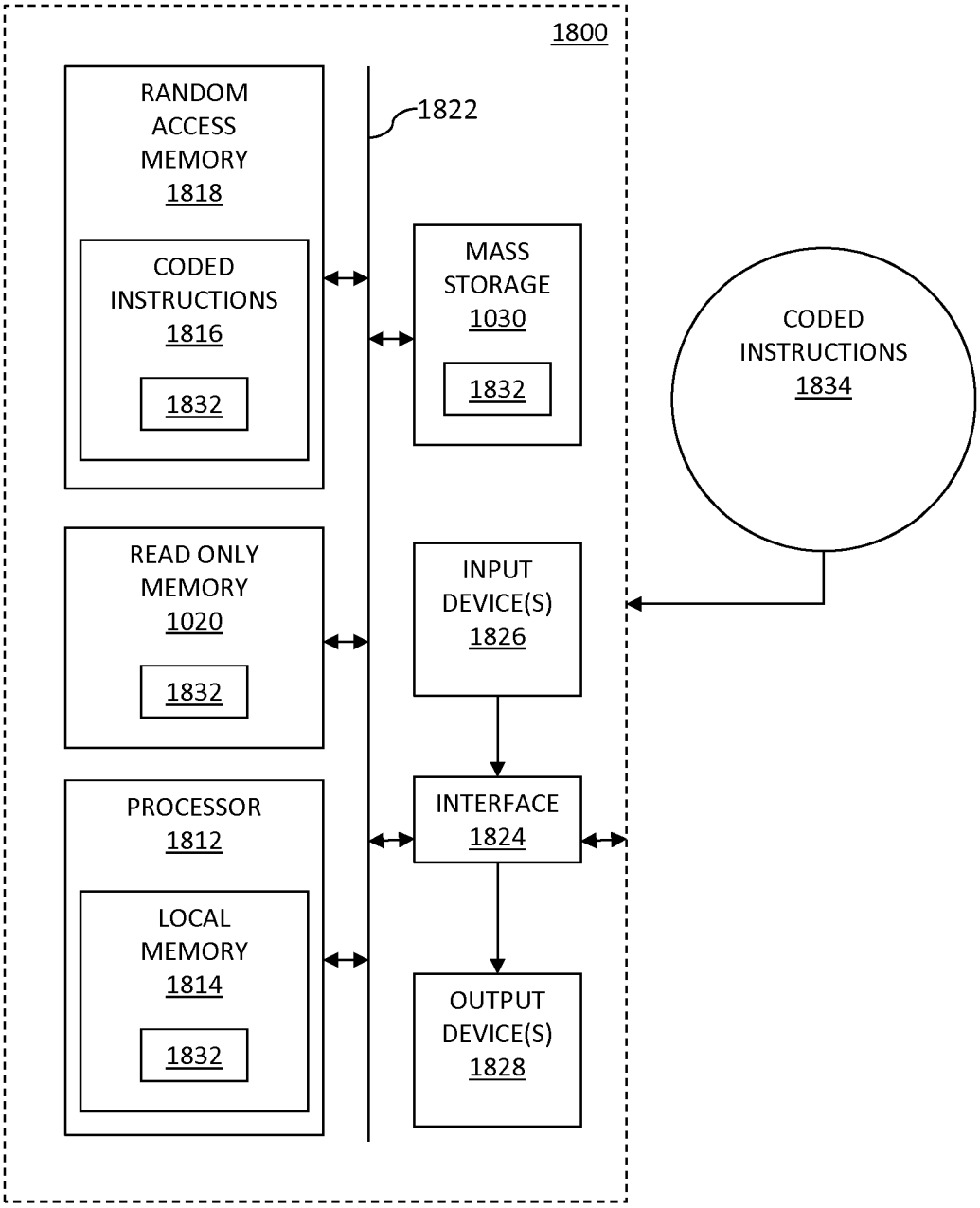
FIG. 18 is a schematic view of at least a portion of apparatus according to one or more aspects of the present disclosure.

FIG. 18 is a block diagram of an example processing system 1800 that may execute example machine-readable instructions used to implement one or more of the methods of FIGS. 16 and/or 17, and/or to implement the example downhole tools and/or other apparatus of FIGS. 1-13 and/or 15. Thus, the example processing system 1800 may be capable of implementing the apparatus and methods disclosed herein. The processing system 1800 may be or comprise, for example, one or more processors, one or more controllers, one or more special-purpose computing devices, one or more servers, one or more personal computers, one or more personal digital assistant (PDA) devices, one or more smartphones, one or more internet appliances, and/or any other type(s) of computing device(s). Moreover, while it is possible that the entirety of the system 1800 shown in FIG. 18 is implemented within the downhole tool, it is also contemplated that one or more components or functions of the system 1800 may be implemented in surface equipment described above or otherwise within the scope of the present disclosure. One or more aspects, components or functions of the system 1800 may also or alternatively be implemented as a controller described above or otherwise within the scope of the present disclosure.

The system 1800 comprises a processor 1812 such as, for example, a general-purpose programmable processor. The processor 1812 includes a local memory 1814, and executes coded instructions 1832 present in the local memory 1814 and/or in another memory device. The processor 1812 may execute, among other things, machine-readable instructions to implement the processes represented in FIGS. 16 and/or 17. The processor 1812 may be, comprise or be implemented by any type of processing unit, such as one or more INTEL microprocessors, one or more microcontrollers from the ARM and/or PICO families of microcontrollers, one or more embedded soft/hard processors in one or more FPGAs, etc. Of course, other processors from other families are also appropriate.

The processor 1812 is in communication with a main memory including a volatile (e.g., random access) memory 1818 and a non-volatile (e.g., read only) memory 1820 via a bus 1822. The volatile memory 1818 may be, comprise or be implemented by static random access memory (SRAM), synchronous dynamic random access memory (SDRAM), dynamic random access memory (DRAM), RAMBUS dynamic random access memory (RDRAM) and/or any other type of random access memory device. The non-volatile memory 1820 may be, comprise or be implemented by flash memory and/or any other desired type of memory device. One or more memory controllers (not shown) may control access to the main memory 1818 and/or 1820.

The processing system 1800 also includes an interface circuit 1824. The interface circuit 1824 may be, comprise or be implemented by any type of interface standard, such as an Ethernet interface, a universal serial bus (USB) and/or a third generation input/output (3GIO) interface, among others.

One or more input devices 1826 are connected to the interface circuit 1824. The input device(s) 1826 permit a user to enter data and commands into the processor 1812. The input device(s) may be, comprise or be implemented by, for example, a keyboard, a mouse, a touchscreen, a trackpad, a trackball, an isopoint and/or a voice recognition system, among others.

One or more output devices 1828 are also connected to the interface circuit 1824. The output devices 1828 may be, comprise or be implemented by, for example, display devices (e.g., a liquid crystal display or cathode ray tube display (CRT), among others), printers and/or speakers, among others. Thus, the interface circuit 1824 may also comprise a graphics driver card.

The interface circuit 1824 also includes a communication device such as a modem or network interface card to facilitate exchange of data with external computers via a network (e.g., Ethernet connection, digital subscriber line (DSL), telephone line, coaxial cable, cellular telephone system, satellite, etc.).

The processing system 1800 also includes one or more mass storage devices 1830 for storing machine-readable instructions and data. Examples of such mass storage devices 1830 include floppy disk drives, hard drive disks, compact disk drives and digital versatile disk (DVD) drives, among others.

The coded instructions 1832 may be stored in the mass storage device 1830, the volatile memory 1818, the non-volatile memory 1820, the local memory 1814 and/or on a removable storage medium, such as a CD or DVD 1834.

As an alternative to implementing the methods and/or apparatus described herein in a system such as the processing system of FIG. 18, the methods and or apparatus described herein may be embedded in a structure such as a processor and/or an ASIC (application specific integrated circuit).

In view of the entirety of the present disclosure, including the figures, those having ordinary skill in the art will readily recognize that the present disclosure introduces a method comprising: conveying a downhole tool within a wellbore penetrating a subterranean formation, wherein the downhole tool comprises a first pump and a second pump, and wherein at least one operational capability of the first and second pumps is substantially different; initiating a fracture in the subterranean formation by pumping fluid into the formation using the first pump; and propagating the fracture in the subterranean formation by pumping fluid into the formation using the second pump. Initiating the fracture using the first pump may comprise operating the first pump at a first pressure, wherein propagating the fracture using the second pump may comprise operating the second pump at a second pressure, and wherein the first pressure may be substantially greater than the second pressure. Initiating the fracture using the first pump may comprise operating the first pump at a first flow rate, wherein propagating the fracture using the second pump may comprise operating the second pump at a second flow rate, and wherein the second flow rate may be substantially greater than the first flow rate. Initiating the fracture using the first pump may comprise operating the first pump at a first pressure and a first flow rate, wherein propagating the fracture using the second pump may comprise operating the second pump at a second pressure and a second flow rate, wherein the first pressure may be substantially greater than the second pressure, and wherein the second flow rate may be substantially greater than the first flow rate.

The method may further comprise isolating a portion of the wellbore before initiating the fracture, wherein initiating the fracture using the first pump may comprise pumping fluid into the isolated portion of the wellbore, and wherein propagating the fracture using the second pump may comprise pumping fluid into the isolated portion of the wellbore. The downhole tool may comprise an outlet by which fluid is pumped from the downhole tool into the subterranean formation, and wherein isolating a portion of the wellbore may comprise inflating a pair of external packers of the downhole tool positioned on opposing sides of the outlet. The downhole tool may comprise a probe having an outlet by which fluid is pumped from the downhole tool into the formation, and wherein isolating a portion of the wellbore may comprise urging the probe into contact with the subterranean formation. Urging the probe into contact with the subterranean formation may comprise hydraulically extending the probe from the downhole tool. Urging the probe into contact with the subterranean formation may comprise hydraulically extending backup pistons thereby urging a substantial portion of the downhole tool into contact with the subterranean formation. The method may further comprise pumping wellbore fluids out of the isolated portion of the wellbore using at least one of the first and second pumps before initiating the fracture.

The method may further comprise measuring a fracture pressure of the formation after initiating the fracture but before propagating the fracture. The method may further comprise measuring a closure pressure of the formation after propagating the fracture.

The method may further comprise pumping fluid from the isolated wellbore portion after propagating the fracture, and then exposing the isolated wellbore portion to an adjacent portion of the wellbore.

The method may further comprise further conveying the downhole tool within the wellbore and repeating the initiating and propagating.

The downhole tool may further comprise at least one motor operatively coupled to the first and second hydraulic pumps, and wherein initiating and propagating the fracture may each comprise operating the at least one motor.

The downhole tool may further comprise: a reservoir containing hydraulic fluid; a hydraulically actuatable device configured to receive pressurized hydraulic fluid; and means for selectively flowing hydraulic fluid from at least one of the first and second pumps to the hydraulically actuatable device. The downhole tool may further comprise at least one motor operatively coupled to the first and second hydraulic pumps, and wherein initiating and propagating the fracture may each comprise operating the at least one motor. The second pump may be fluidly disposed between the first pump and the reservoir. The maximum flow rate of the first pump may be less than a minimum flow rate of the second pump. The means for selectively flowing hydraulic fluid may include a clutch between the at least one motor and the second pump. The means for selectively flowing hydraulic fluid may include a first valve configured for routing at least part of the hydraulic fluid from the second pump to one of the second pump and the reservoir. The downhole tool may further comprise a second valve fluidly disposed between the second pump and the first pump to prevent fluid pumped by the second pump from flowing into the first pump. The downhole tool may further comprise a third valve fluidly disposed between the first pump and the second pump to prevent fluid pumped by the first pump from flowing into the second pump. The second pump, when actuated in a first direction, may be to flow fluid and, when actuated in a second direction, may be to substantially not flow fluid, wherein the means for selectively flowing hydraulic fluid may include at least one shaft coupling the at least one motor to the first pump and the second pump, and wherein the at least one motor may be to rotate in a selective one of the first and the second directions. The means for selectively flowing hydraulic fluid may include a second motor mechanically coupled to the second pump, and wherein the at least one motor and the second motor may be independently actuatable. The hydraulically actuatable device may comprise a displacement unit including an actuation chamber for one of traversing formation fluid into and out of the downhole tool. At least one of the first pump and the second pump may be a variable-displacement pump. At least one of the first pump and the second pump may be a fixed-displacement pump. One of the first pump and the second pump may be a variable-displacement pump, and the other of the first pump and the second pump may be a fixed-displacement pump.

The present disclosure also introduces a method comprising: conveying a downhole tool to a first depth within a wellbore penetrating a subterranean formation, wherein the downhole tool comprises a first pump a second pump; and without further conveying the downhole tool within the wellbore: pumping fluid into the subterranean formation with the first pump utilizing a first flow rate and a first pressure; and pumping fluid into the subterranean formation with at least the second pump utilizing a second flow rate and a second pressure. The first flow rate may be substantially less than the second flow rate. The first pressure may be substantially greater than the second pressure. The first flow rate may be substantially less than the second flow rate, wherein the first pressure may be substantially greater than the second pressure. Pumping fluid into the subterranean formation with the first pump utilizing the first flow rate and the first pressure may comprise initiating a fracture in the subterranean formation, wherein pumping fluid into the subterranean formation with at least the second pump utilizing the second flow rate and the second pressure may comprise propagating the fracture.

The method may further comprise isolating a portion of the wellbore before initiating the fracture, wherein initiating the fracture using the first pump may comprise pumping fluid into the isolated portion of the wellbore, and wherein propagating the fracture using the second pump may comprise pumping fluid into the isolated portion of the wellbore.

Pumping fluid into the subterranean formation with at least the second pump utilizing the second flow rate and the second pressure may comprise pumping fluid into the subterranean formation with the first and second pumps, wherein the second flow rate may account for the flow rate of each of the first and second pumps, and wherein the second pressure may be a combined output pressure of the first and second pumps.

The downhole tool may comprises a motor operably coupled to the first and second pumps, wherein pumping fluid into the subterranean formation with the first pump may comprise operating the motor in a first rotational direction, and wherein pumping fluid into the subterranean formation with at least the second pump may comprise operating the motor in a second rotational direction substantially opposite to the first rotational direction.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

conveying a downhole tool within a wellbore penetrating a subterranean formation, wherein the downhole tool comprises a first pump and a second pump both disposed within the downhole tool, and wherein the second pump has a larger displacement than the first pump;

isolating a portion of the wellbore comprising inflating a pair of external packers of the downhole tool positioned on opposing sides of an outlet of a probe;

initiating a fracture in the subterranean formation after isolating the portion of the wellbore by pumping fluid into the formation using the first pump via the probe, wherein initiating the fracture using the first pump comprises pumping fluid into the isolated portion of the wellbore;

stopping operation of the first pump in response to detecting initiation of the fracture;

propagating the fracture in the subterranean formation by pumping fluid into the formation using the second pump via the probe, wherein propagating the fracture using the second pump comprises pumping fluid into the isolated portion of the wellbore;

measuring a fracture pressure of the formation after initiating the fracture but before propagating the fracture; and measuring a closure pressure of the formation after propagating the fracture.

2. The method of claim 1 wherein initiating the fracture using the first pump comprises operating the first pump at a first pressure, wherein propagating the fracture using the second pump comprises operating the second pump at a second pressure, and wherein the first pressure is substantially greater than the second pressure.

3. The method of claim 1 wherein initiating the fracture using the first pump comprises operating the first pump at a first flow rate, wherein propagating the fracture using the second pump comprises operating the second pump at a second flow rate, and wherein the second flow rate is substantially greater than the first flow rate.

4. The method of claim 1 further comprising pumping wellbore fluids out of the isolated portion of the wellbore using at least one of the first and second pumps before initiating the fracture.

5. The method of claim 1 further comprising further conveying the downhole tool within the wellbore and repeating the initiating and propagating.

6. The method of claim 1 wherein the maximum flow rate of the first pump is less than a minimum flow rate of the second pump.

7. The method of claim 1 wherein the downhole tool further comprises:

a reservoir containing hydraulic fluid;

a hydraulically actuatable device configured to receive pressurized hydraulic fluid, wherein the hydraulically actuatable device comprises a displacement unit including an actuation chamber for one of traversing formation fluid into and out of the downhole tool; and means for selectively flowing hydraulic fluid from at least one of the first and second pumps to the hydraulically actuatable device.

8. The method of claim 1 wherein the downhole tool further comprises at least one motor operatively coupled to the first and second pumps, and wherein initiating and propagating the fracture each comprise operating the at least one motor.

9. The method of claim 8 wherein the second pump when actuated in a first direction is to flow fluid and when actuated in a second direction is to substantially not flow fluid, wherein the means for selectively flowing hydraulic fluid include at least one shaft coupling the at least one motor to the first pump and the second pump, and wherein the at least one motor is to rotate in a selective one of the first and the second directions.

10. The method of claim 1 wherein one of the first pump and the second pump is a variable-displacement pump, and wherein the other of the first pump and the second pump is a fixed-displacement pump.

11. The method of claim 1 wherein stopping operation of the pump comprises switching pumping operations from the first pump to the second pump.

12. The method of claim 1, wherein the probe comprises an extendable probe configured to extend from the downhole tool to contact the subterranean formation or a non-extendable probe configured to contact the subterranean formation via extension of a backup piston of the downhole tool.

13. A method, comprising:

conveying a downhole tool to a first depth within a wellbore penetrating a subterranean formation, wherein the downhole tool comprises a first pump and a second pump both disposed within the downhole tool, and wherein the second pump has a larger displacement than the first pump; and without further conveying the downhole tool within the wellbore:

isolating a portion of the wellbore;

pumping fluid into the isolated portion of the wellbore with the first pump via a probe utilizing a first flow rate and a first pressure to initiate a fracture in the subterranean formation after isolating the portion of the wellbore;

stopping operation of the first pump and enabling operation of the second pump in response to detecting initiation of the fracture;

pumping fluid into the isolated portion of the wellbore with at least the second pump via the probe utilizing a second flow rate and a second pressure to propagate the fracture;

measuring a fracture pressure of the formation after initiating the fracture but before propagating the fracture; and measuring a closure pressure of the formation after propagating the fracture.

14. The method of claim 13 wherein the first flow rate is substantially less than the second flow rate.

15. The method of claim 13 wherein the first pressure is substantially greater than the second pressure.

16. The method of claim 13 wherein the downhole tool comprises a motor operably coupled to the first and second pumps, wherein pumping fluid into the subterranean formation with the first pump comprises operating the motor in a first rotational direction, and wherein pumping fluid into the subterranean formation with at least the second pump comprises operating the motor in a second rotational direction substantially opposite to the first rotational direction.

* * * * *